United States Patent [19]

Takahashi et al.

[11] Patent Number: 4,495,261

[45] Date of Patent: Jan. 22, 1985

[54] ELECTROPHOTOGRAPHIC SUBSTITUTED P,P'-BISAZO DIPHENYL ACRYLONITRILE COMPOUNDS FOR PHOTORECEPTORS

[75] Inventors: Jiro Takahashi; Tawara Komamura; Kiyoshi Sawada, all of Hachioji; Ssamu Sasaki, Hino; Satoshi Goto, Hachioji; Akira Kinoshita, Hino, all of Japan

[73] Assignee: Konishiroku Photo Industry Co., Ltd., Tokyo, Japan

[21] Appl. No.: 453,281

[22] Filed: Dec. 27, 1982

[30] Foreign Application Priority Data

Dec. 28, 1981 [JP] Japan ..... 56-213834

[51] Int. Cl.[3] ..... G03G 5/06

[52] U.S. Cl. ..... 430/58; 430/72; 430/73; 430/79

[58] Field of Search ..... 430/58, 72, 76, 78, 430/79, 73; 260/152, 155

[56] References Cited

U.S. PATENT DOCUMENTS 4,314,016 2/1982 Ohta et al. ..... 430/73

4,359,513 11/1982 Katagiri et al. ..... 430/76

*Primary Examiner*—John E. Kittle

*Assistant Examiner*—John L. Goodrow

*Attorney, Agent, or Firm*—Jordan B. Bierman

[57] ABSTRACT

An electrophotograhic photoreceptor that has great ability to generate carriers and which has high sensitivity but low residual potential is disclosed. This photoreceptor is characterized by having formed on an electrically conductive support a light-sensitive layer containing a bisazo compound of the following formula:

(wherein $R_1$ is a cyano group, a chlorine atom or a bromine atom; $X_1$ is a halogen atom, an alkyl group, an alkoxy group or a cyano group; $X_2$ is a hydrogen atom, a halogen atom, an alkyl atom or an alkoxy group; A is wherein Y is a substituted or unsubstituted carbamoyl group or a substituted or unsubstituted sulfamoyl group; Z is an atomic group necessary for forming a substituted or unsubstituted aromatic hydrocarbon ring or a substituted or unsubstituted heteroaromatic ring; $R_2$ is a hydrogen atom, a substituted or unsubstituted amino group, a substituted or unsubstituted carbamoyl group, a carboxy group or an ester group thereof; and A' is a substituted or unsubstituted aryl group).

11 Claims, 8 Drawing Figures

ELECTROPHOTOGRAPHIC SUBSTITUTED P,P'-BISAZO DIPHENYL ACRYLONITRILE COMPOUNDS FOR PHOTORECEPTORS

FIELD OF THE INVENTION

The present invention relates to an electrophotographic photoreceptor, and more particularly to a new electrophotographic photoreceptor having a light-sensitive layer containing a bisazo compound.

BACKGROUND OF THE INVENTION

Most of the conventional electrophotographic photoreceptors use light-sensitive layers that contain, selenium, zinc oxide, cadmium sulfide and other inorganic photo-conductors as the primary component. But none of these photoreceptors have satisfactory heat resistance, moisture resistance or printing life. Further, great difficulties are met in manufacture and handling those using selenium and cadmium sulfide due to their toxicity.

Electrophotographic photoreceptors using light-sensitive layers containing organic photo-conductive compounds are also known, and they are getting an increasing amount of researchers' attention these days because they are fairly easy to manufacture, the production cost is low, they can be fabricated into a cylindrical drum or sheet form, they are easy to handle, and unlike the selenium photoreceptor that is so low in heat resistance that it crystallizes under elevated temperatures, the new photoreceptors have high heat resistance.

Among the organic photo-conductive compounds, poly-N-vinylcarbazole is best known, and an electrophotographic photoreceptor having a light-sensitive layer that contains as the main component a charge transfer complex formed from the poly-N-vinylcarbazole and a Lewis acid such as 2,4,7-trinitro-9-fluorenone is currently used in industry. But even this photoreceptor does not have satisfactory sensitivity or printing life.

A two-layer or dispersed type photoreceptor wherein the carrier generating function and carrier transporting function are fulfilled by two different materials is known. This function-separated photoreceptor permits great latitude in selecting the proper materials, is fairly easy to provide better electrophotographic characteristics including charge acceptance, sensitivity, residual potential and printing life, and a photoreceptor having the desired characteristics can be fabricated. Various carrier generating materials have been proposed, and a carrier generating layer formed of amorphous selenium as an inorganic material is well known, but this has one great problem; under elevated temperatures, it crystallizes and deteriorates.

Photo-conductive organic dyes and pigments that have particularly high carrier generating capacity have been proposed for use as carrier generating materials. Among them are the perylene pigments described in U.S. Pat. No. 3,871,882, as well as the azo compounds disclosed in Japanese Patent Applications (OPI) Nos. 37543/72, 4241/77, 95033/78, 79632/79 and 69147/80 (the symbol OPI as used herein means an unexamined published Japanese patent application). But electrophotographic photoreceptors wherein these compounds are combined with carrier transporting materials do not have satisfactory characteristics such as sensitivity and residual potential, and if they have fairly good characteristics, such characteristics will not remain constant over extended use, and as they are subjected to cyclic operation, their sensitivity is decreased or the residual potential is increased. Some of the bisazo compounds described in the above patents commercially used, but photoreceptors using them are still vulnerable to temperature variations with respect to sensitivity, dark decay and residual potential.

In the electrophotographic photoreceptor using an organic photoconductive compound, carrier transfer is generally considered to take place by the hopping process, wherein the carrier transfer is accelerated by heat. Furthermore, carriers that have been captured in a relatively shallow trap are released by heat to generate a thermally stimulated current, which leads to an increased dark current.

Most bisazo compounds are known to have various crystal forms, which may be transformed by heat. There is a close relation between the crystal form of a specific bisazo compound and its electrophotographic characteristics, and depending on the crystal form, some bisazo compounds cannot be used commercially as light-conductive materials in photoreceptors.

The electrophotographic characteristics such as sensitivity, dark decay and residual potential are temperature-dependent. On the other hand, the temperature in an electro-photocopier has a tendency to increase during continuous operation due to the heat from the light source and fixing device. This tendency is increased as the size of the copier is decreased, and in small compact models, the surface temperature of the photoreceptor may reach as high 60° C. On the other hand, in winter the same temperature may drop to 10° C. or below in an unheated room.

If the sensitivity of the photoreceptor changes greatly with such temperature variation, it is difficult to produce a good copy image over extended use unless a cooling fan or an exposure control device such as aperature is installed in the copying machine. Alternatively, a trial printing is necessary for producing optimum copy image and this makes the copying procedure complicated. Therefore, a commercial photoreceptor for electrophotography should desirably be usable over a wide temperature range with minimum variations in its characteristics.

SUMMARY OF THE INVENTION

One object of the present invention is to provide an electrophotographic photoreceptor that contains a bisazo compound having great carrier generating ability and which achieves high sensitivity with small residual potential.

Another object of the invention is to provide an electrophotographic photoreceptor whose characteristics change little with temperature variations occurring in an electrophotocopier.

As a result of various studies to achieve these objects, we have found that the objects can be successfully attained by incorporating a bisazo compound of formula (I) as an effective component of the photoreceptor:

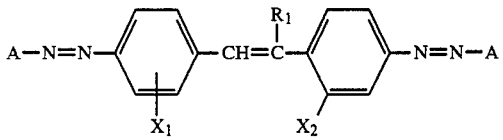

(wherein $R_1$ is a cyano group, a chlorine atom or a bromine atom; $X_1$ is a halogen atom, an alkyl group, an alkoxy group or a cyano group; $X_2$ is a hydrogen atom, a halogen atom, an alkyl atom or an alkoxy group; A is

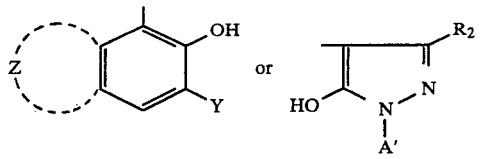

wherein Y is a substituted or unsubstituted carbamoyl group or a substituted or unsubstituted sulfamoyl group; Z is an atomic group necessary for forming a substituted or unsubstituted aromatic hydrocarbon ring or a substituted or unsubstituted heteroaromatic ring; $R_2$ is a hydrogen atom, a substituted or unsubstituted amino group, a substituted or unsubstituted carbamoyl group, a carboxy group or an ester group thereof; and A' is a substituted or unsubstituted aryl group).

According to the present invention, by using the bisazo compound of formula (I) as a photoconductive material that makes up the light-sensitive layer of an electrophotographic photoreceptor, or by using the same as a carrier generating material in a function-separated photoreceptor, a photoreceptor that has good characteristics such as sensitivity and residual potential and which varies little with temperature and can be operated over a wide temperature range without deterioration can be produced.

DETAILED DESCRIPTION OF THE INVENTION

While no theoretical explanation can be made, the substituent on the phenylene ring of formula (I) is believed to be effective in decreasing the temperature-dependency of the electrophotographic characteristics.

The bisazo compounds of formula (I) that can be used with advantage in the present invention are illustrated by, but are by no means limited to, those which are listed below. These bisazo compounds have good photo-conducting properties, and an electrophotographic photoreceptor can be prepared by forming on an electrically conductive support a light-sensitive layer having the bisazo compounds dispersed in a binder. Alternatively, the bisazo compounds which have particularly good carrier generating ability are used as carrier generating materials which are combined with an effective carrier transporting material to thereby form a two-layer or dispersed type functionseparated photoreceptor.

Figure 1:
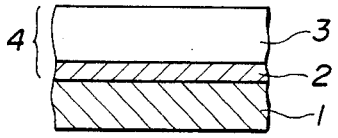
FIGS. 1 to 6 are cross-sectional views of the photoreceptor of the present invention in different embodiments.
Figure 2:
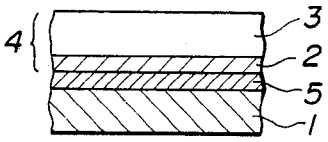
Figure 3:
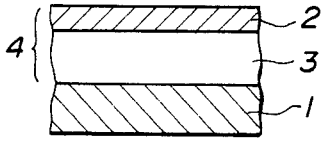
Figure 4:
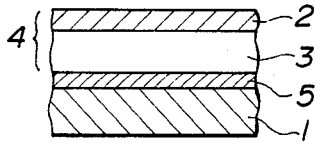
Figure 5:
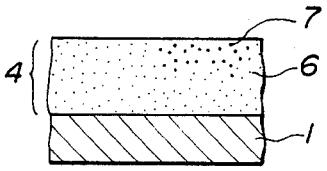
Figure 6:
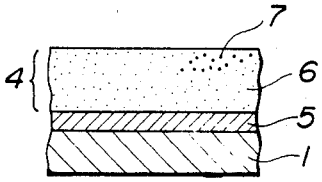

The photoreceptor of the present invention may use any known layer arrangement. Typical arrangements are shown in FIGS. 1 to 6. In FIGS. 1 to 3, an electrically conductive support 1 is coated with a carrier generating layer 2 that contains the bisazo compound of formula (I) as a main component, which is overlaid with a carrier transporting layer 3 that contains a carrier transporting material as a primary component, the two layers 2 and 3 forming a light-sensitive layer 4. As shown in FIGS. 2 and 4, the light-sensitive layer 4 may be formed on the support via an intermediate layer 5. The illustrated double-layer arrangement is most effective in producing a photoreceptor having the desired electrophotographic characteristics. Alternatively, as shown in FIGS. 5 and 6, a light-sensitive layer 4 having the carrier generating layer 7 of formula (I) dispersed in a layer 6 containing a carrier transporting material as a main component is formed on the conductive support 1 either directly or through an intermediate layer.

The bisazo compounds of the present invention may, when used as carrier generating materials, be combined with carrier transporting materials, which include electron acceptors such as trinitrofluorenone and tetranitrofluorenone that have high ability to transport electrons, polymers such as poly-N-vinylcarbazole that have a heterocylic ring in side chains, as well as electron donors that have great ability to transport holes such as triazole derivatives, oxadiazole derivatives, imidazole derivatives, pyrazoline derivatives, polyaryl alkane derivatives, phenylenediamine derivatives, hydrazone derivatives, triaryl amine derivatives, amino-substituted chalcone derivatives, and styryl carbazole derivatives. It is to be understood that the carrier transporting materials that can be used in the present invention are by no means limited to the above-named examples.

Illustrative bisazo compounds

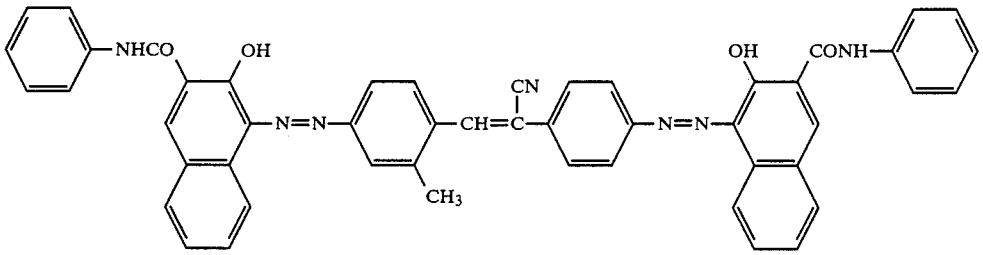

(1)

-continued
Illustrative bisazo compounds
(2)
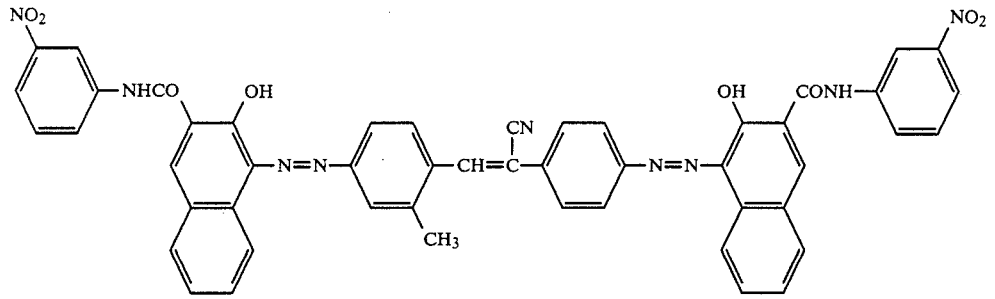
(3)
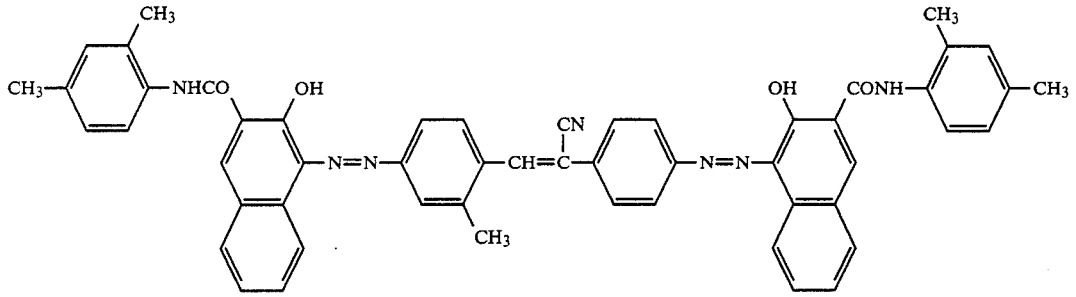
(4)
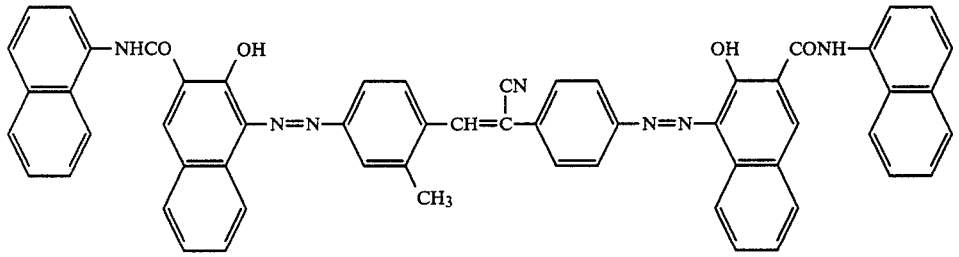
(5)
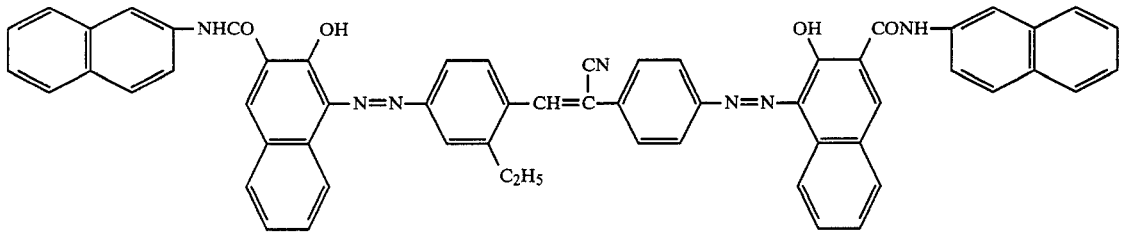
(6)
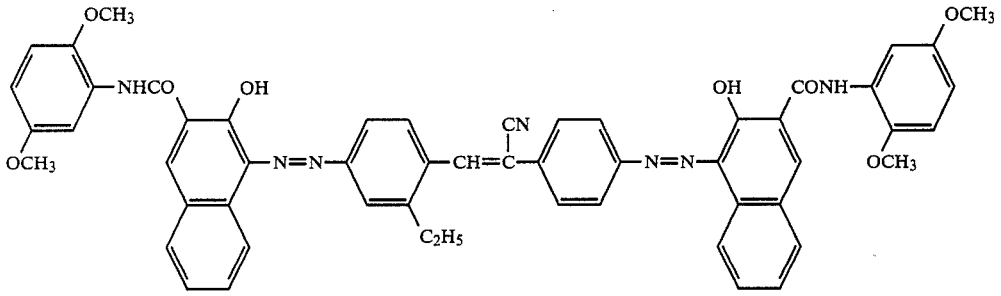

-continued
Illustrative bisazo compounds
(7)
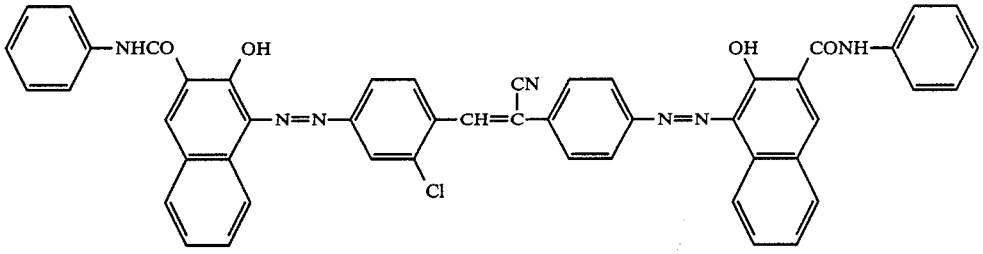
(8)
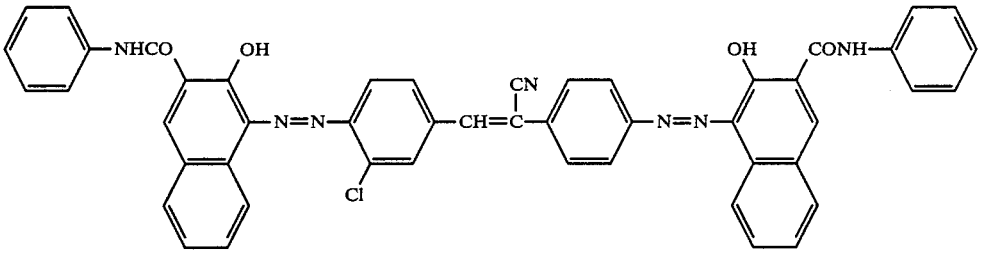
(9)
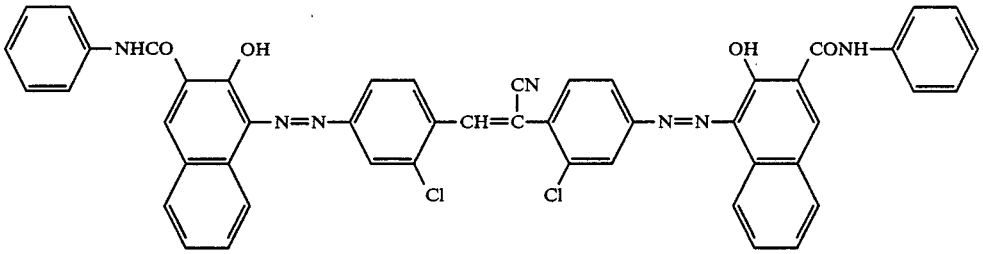
(10)
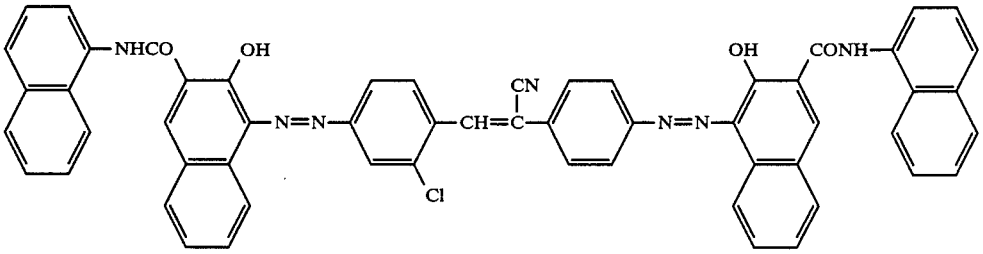
(11)
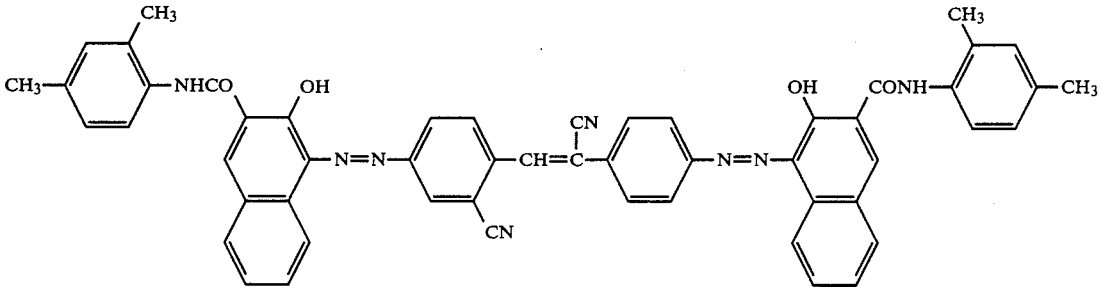
(12)
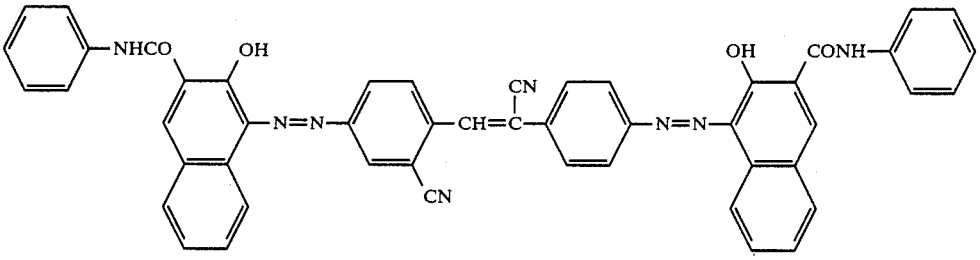

-continued
Illustrative bisazo compounds
(13)
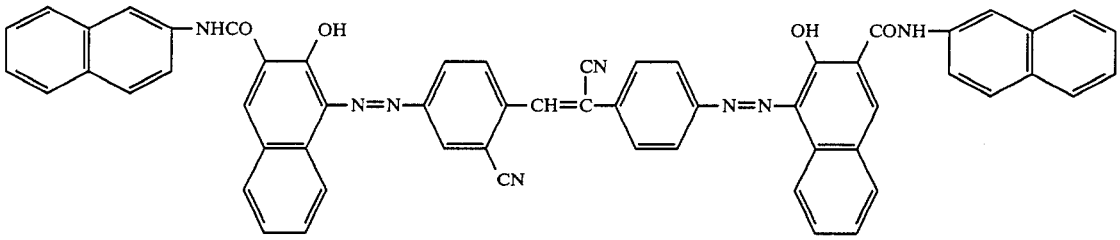
(14)
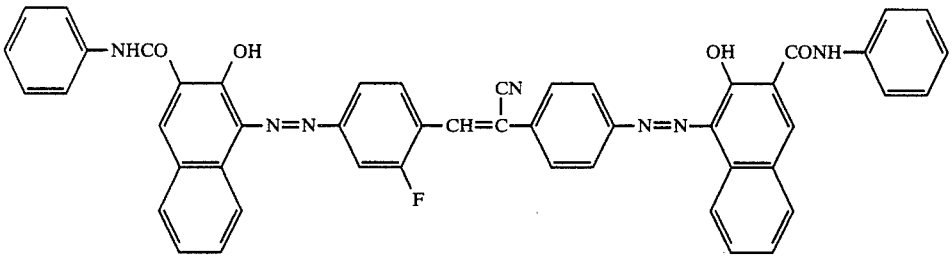
(15)
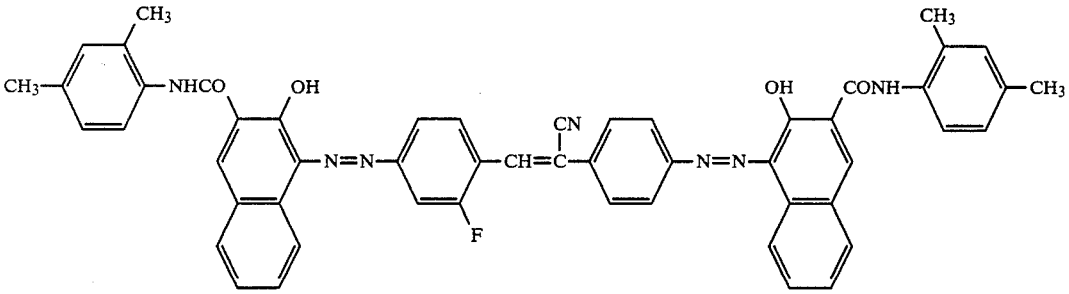
(16)
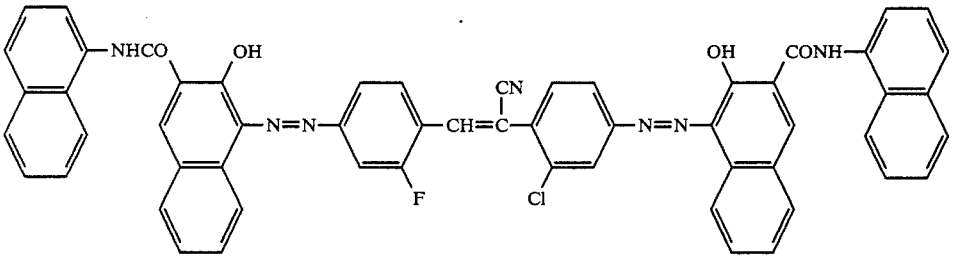
(17)
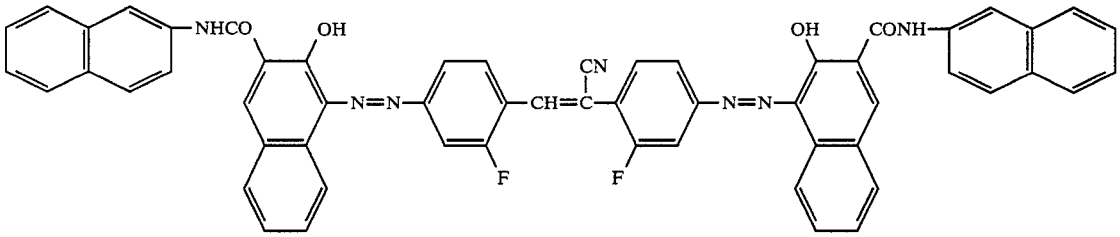
(18)
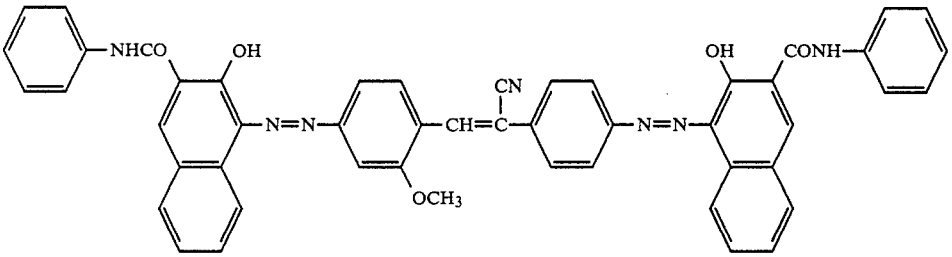

-continued
Illustrative bisazo compounds
(19)
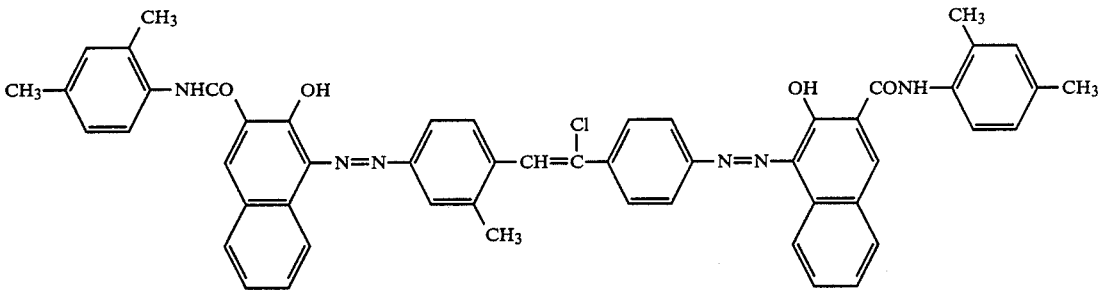
(20)
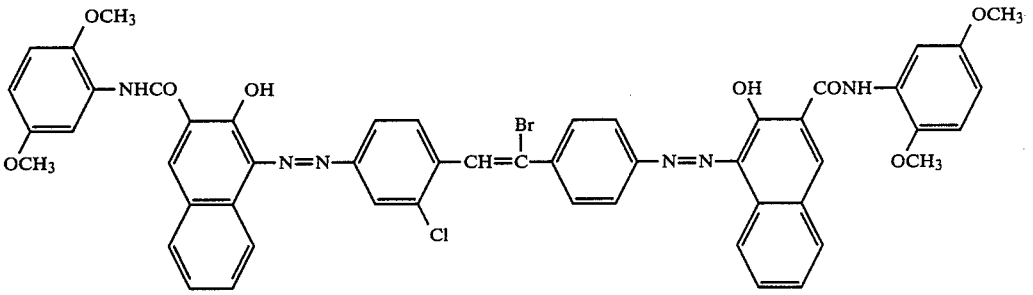
(21)
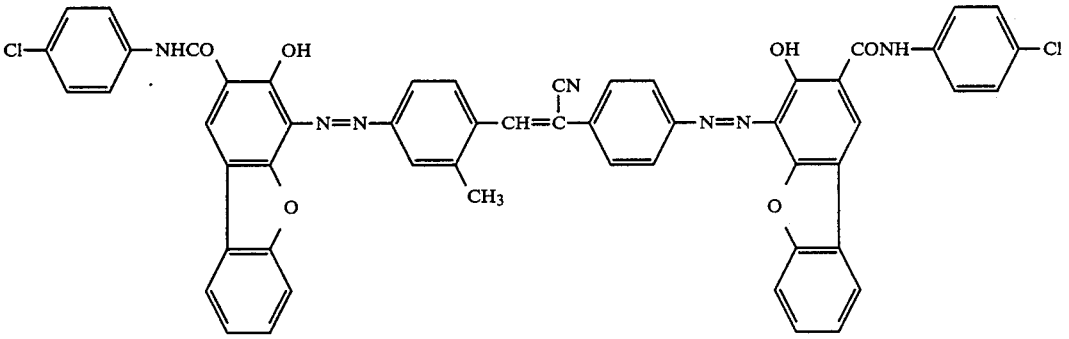
(22)
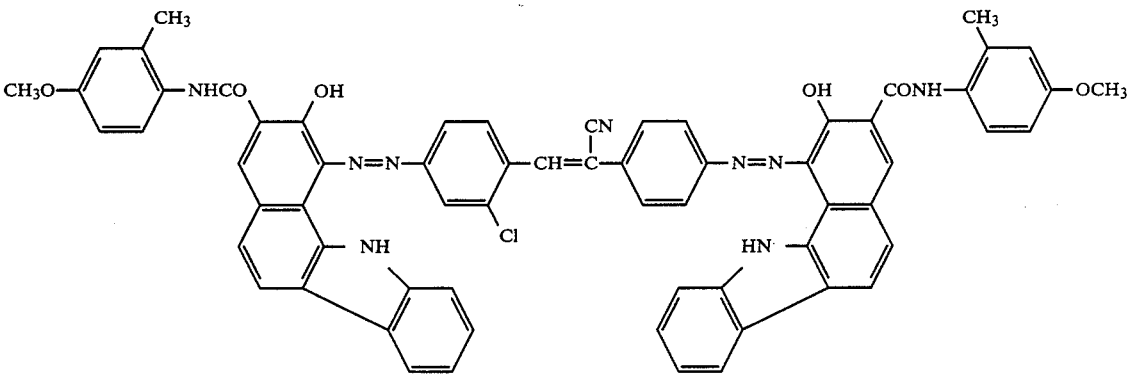
(23)
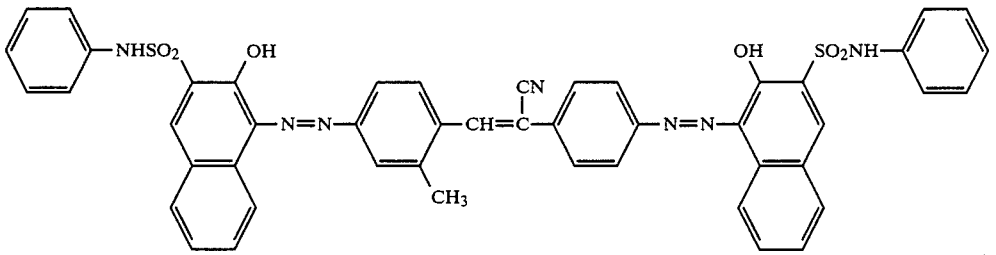

-continued

Illustrative bisazo compounds (24)

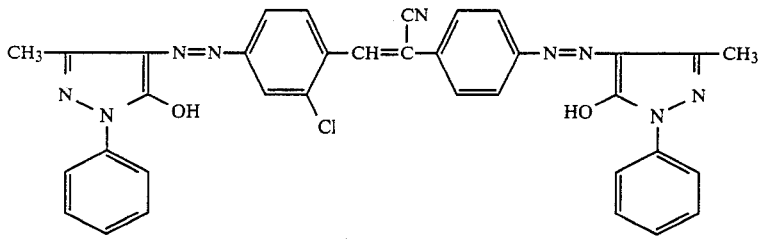

(25)

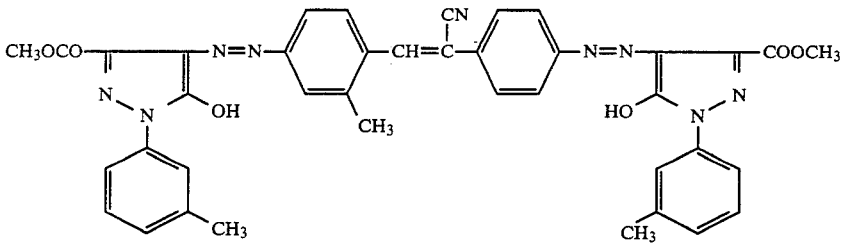

(26)

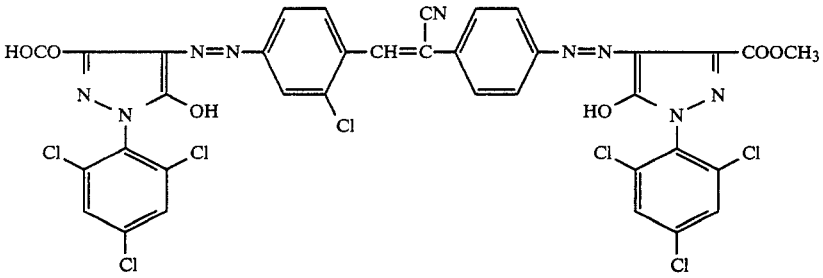

(27)

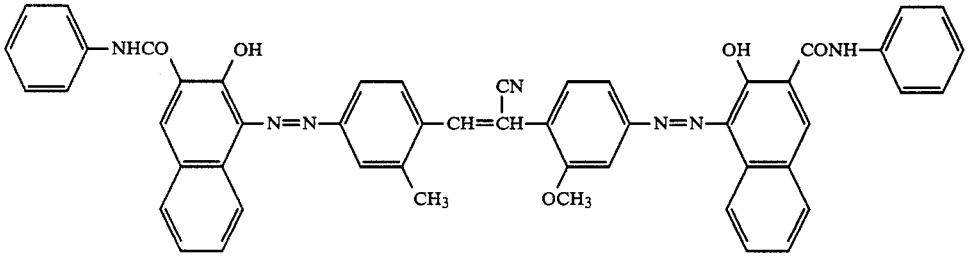

The above listed bisazo compounds can be easily produced by any known method.

Synthesis of compound (1)

2-methyl-4-nitrobenzaldehyde was condensed with p-nitrobenzyl cyanide in the presence of piperidine, and the resulting 1-cyano-1-(4-nitrophenyl)-2-(2-methyl-4-nitrophenyl)ethylene was reduced with tin and hydrochloric acid to product 1-cyano-1-(4-aminophenyl)-2-(2-methyl-4-aminophenyl)ethylene. In a mixture of 5 ml of hydrochloric acid and 10 ml of water, 2.5 g (0.01 mole) of the 1-cyano-1-(4-aminophenyl)-2-(2-methyl-4-aminophenyl)ethylene was dispersed, and a solution of 1.38 g (0.02 mole) of sodium nitrite in 4 ml of water was added dropwise to the dispersion under cooling with ice and thereafter, the mixture was stirred for one hour while it was held at 5° C. or below. After the reaction, the insoluble matter was filtered out, and to the filtrate 7.5 g of borofluoric acid was added. The resulting crystal was filtered, washed with water and dried. The tetrazonium salt obtained was dissolved in 90 ml of N,N-dimethylformamide in preparation for the subsequent reaction.

To a solution of 5.27 g (0.02 mole) of 2-hydroxy-3-naphthoic acid anilide (Naphthol AS) in 900 ml of N,N-dimethylformamide, 16 g of sodium acetate was added with vigorous stirring. To the solution, the previously prepared tetrazonium salt solution was added dropwise under cooling with ice, and thereafter, the mixture was stirred for 4 more hours under cooling with ice.

The resulting crystal was filtered, washed first with N,N-dimethylformamide, then with acetone, and dried to produce 3.5 g of the titled bisazo compound having a melting point of 300° C. or higher. It was found to be identical with the end compound by FD mass spectrum; m/e: 798 (molecular ion +1 peak ).

The carrier generating layer 2 that forms one of the two layers of the light-sensitive layer 4 is formed on the conductive support 1 or carrier transporting layer 3 either directly or through an intermediate layer such as an adhesive or barrier layer. The layer 2 can be formed by any of the following two methods:

(1) The bisazo compound is dissolved in a suitable solvent either alone or in the presence of a binder, and the resulting solution is coated onto the selected layer; and (2) The bisazo compound is reduced to fine particles in a dispersion medium by a ball mill or homomixer either alone or in the presence of a binder, and the resulting solution is coated onto the selected layer.

Examples of the solvent or dispersion medium that can be used in forming the carrier generating layer include n-butylamine, diethylamine, ethylenediamine, isopropanolamine, triethanolamine, triethylenediamine, N,N-dimethylformamide, acetone, methyl ethyl ketone, cyclohexanone, benzene, toluene, xylene, chloroform, dichloroethane, dichloromethane, tetrahydrofuran, dioxane, methanol, ethanol, isopropanol, ethyl acetate, butyl acetate and chlorobenzene.

Any binder can be incorporated in the carrier generating or transporting layer. Preferred are those high-molecular polymers which are hydrophobic, have high dieleectric constant and are electrically insulating. These polymers are illustrated by, but are by no means limited to, the following examples:

(1) polycarbonates;
(2) polyesters;
(3) methacrylic resins;
(4) acrylic resins;
(5) polyvinyl chloride;
(6) polyvinylidene chloride;
(7) polystyrene;
(8) polyvinyl acetate;
(9) styrene-butadiene copolymer;
(10) vinylidene chloride-acrylonitrile copolymer;
(11) vinyl chloride-vinyl acetate copolymer;
(12) vinyl chloride-vinyl acetate-maleic anhydride copolymer;
(13) silicone resins;
(14) silicone-alkyed resin;
(15) phenol-formaldehyde resin; and
(16) poly-N-vinyl carbazole.

These binders can be used either alone or in combination.

The so prepared carrier generating layer 2 preferably has a thickness between 0.01 micron and 10 microns, and more preferably, between 0.05 micron and 5 microns. If the carrier generating layer or the light-sensitive layer is made of a dispersion system, the particles of the bisazo compound preferably have a size of not more than 5 microns, more preferably not exceeding 1 micron.

When a binder is incorporated in the carrier generating layer, it is preferred that not more than 3 parts by weight of the binder be used per part by weight of the bisazo compound.

Illustrative conductive supports for use in the photoreceptor of the present invention include metal (e.g. aluminum, stainless), plates, paper or plastic films rendered conductive by coating conductive polymers, by deposition conductive compounds such as indium oxide and tin oxide, or by lamination with thin metal layers such as aluminum or palladium. Examples of the intermediate layer (e.g. adhesive or barrier layer) include not only the high-molecular polymers illustrated above for use as binders but also organic high-molecular materials such as casein, polyvinyl alcohol, methyl cellulose and carboxymethyl cellulose, as well as aluminum oxide.

Having the configuration described above, the photoreceptor of the present invention, as will be understood from the examples that follow, has good electrophotographic characteristics such as high sensitivity and low residual potential, and these characteristics will remain constant over a wide variation in temperature in the copying machine, and hence, the photoreceptor can be used reliably for cyclic operation.

The present invention is now described in greater detail by reference to the following examples which are given here for illustrative purposes only and are by no means intended to limit the scope of the invention.

EXAMPLE 1

An electrically conductive support comprising a polyester film laminated with an aluminum foil was coated with an intermediate layer 0.05 micron thick that was formed of a vinyl chloride-vinyl acetate-maleic anhydride copolymer ("ES-lec MF-10" of Sekisui Chemical Co., Ltd.). A carrier generating layer was formed on the intermediate layer by applying a dispersion of 2 parts by weight of bisazo compound (1) in 140 parts by weight of 1,2-dichloroethane in a dry thickness of 0.5 micron.

Then, a mixture of 6 parts by weight of N,N-diethylaminobenzaldehyde-N,N-diphenylhydrazone having the following formula:

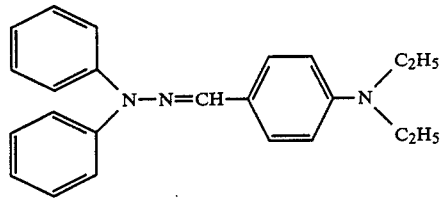

and 10 parts by weight of a polycarbonate, "Panlite L-1250" of Teijin Chemicals Ltd., was dissolved in 90 parts by weight of 1,2-dichloroethane, and the resulting solution was applied to the carrier generating layer to thereby form a carrier transporting layer in a dry thickness of 12 microns.

Figure 7:
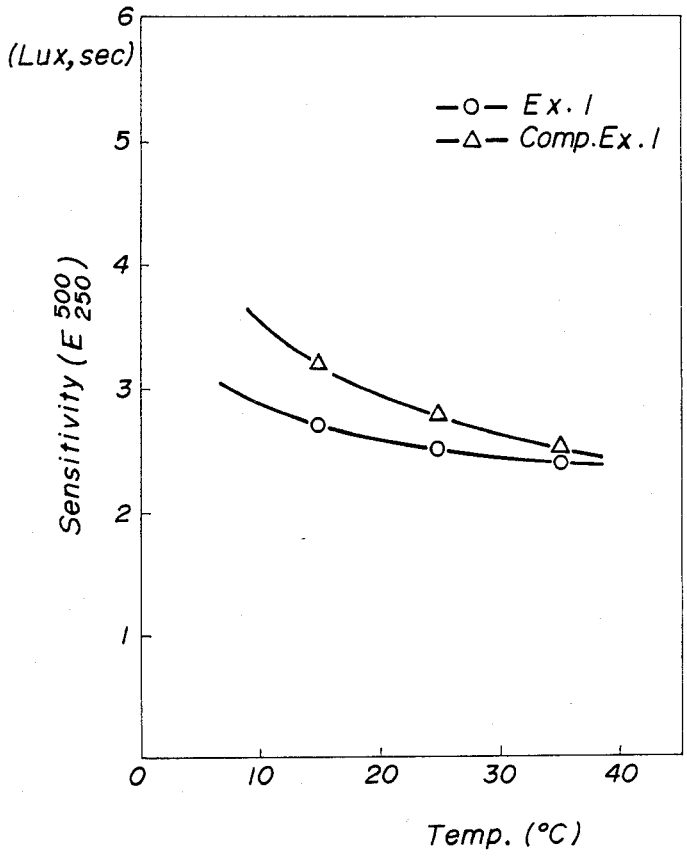
FIG. 7 is a graph showing the temperature versus sensitivity profile of the samples prepared in Example 1 and Comparative Example 1.

The photoreceptor thus prepared was subjected to the following sensitivity test with a paper analizer, "Model SP-428" of Kawaguchi Electric Works Co., Ltd., at three different temperatures, 15° C., 25° C. and 35° C. The surface of the photoreceptor was charged with a charging device at 6 kV for 5 seconds to give a surface potential of −500 V or more. Then, the photoreceptor was illuminated with a halogen lamp to give a luminosity of 35 lux. The amount of exposure ($E_{250}^{500}$ in lux.sec) necessary for reducing the surface potential from −500 V to −250 V, as well as the amount of exposure ($E_{50}^{500}$ in lux.sec) necessary for reducing the surface potential from −500 V to −50 V were measured. After exposure to 30 lux.sec., the residual surface potential $V_R$ was measured. The results are shown in Table 1 and graphed in FIG. 7.

COMPARATIVE EXAMPLE 1

A comparative sample of photoreceptor was prepared by repeating the procedure of Example 1 except that the following bisazo compound was used as the carrier generating material.

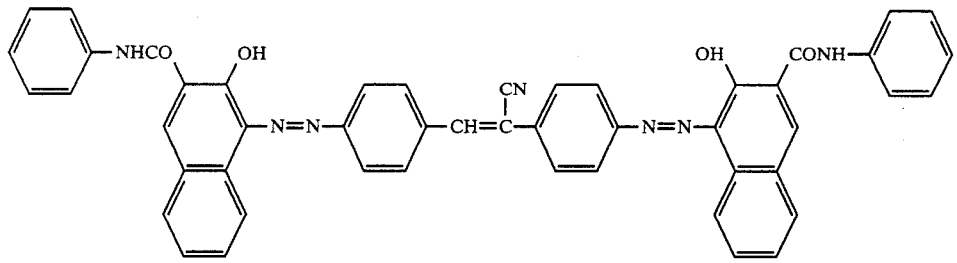

The sample was subjected to the same performance test as in Example 1. The results are shown in Table 1 and depicted in FIG. 7.

TABLE 1

| | | 15° C. | 25° C. | 35° C. |
|---|---|---|---|---|
| Example 1 | $E_{250}^{500}$ (lux · sec) | 2.7 | 2.5 | 2.4 |
| | $E_{50}^{500}$ (lux · sec) | 5.7 | 5.4 | 5.3 |
| | $V_R$ (V) | 0 | 0 | 0 |
| Comparative Example 1 | $E_{250}^{500}$ (lux · sec) | 3.2 | 2.8 | 2.5 |
| | $E_{50}^{500}$ (lux · sec) | 7.3 | 6.2 | 5.7 |
| | $V_R$ (V) | −5 | 0 | 0 |

The above data shows that the photoreceptor of Example 1 had higher sensitivity and lower residual potential than the comparative sample, and its characteristics were little dependent on temperature.

EXAMPLE 2

A polyester film having an aluminum deposited layer was coated with an intermediate layer of polyester, "Vylon 200" of Toyobo Co., Ltd., in a thickness of 0.5 micron. A dispersion 2 of parts by weight of bisazo compound (10) and 2 parts by weight of polycarbonate, "Panlite L-1250" of Teijin Chemicals Ltd., in 140 parts by weight of 1,2-dichloroethane was applied onto the intermediate layer to form a carrier generating layer in a dry thickness of 1 micron.

Then, a mixture of 6 parts by weight of 3-methoxy-6-(p-methoxystyryl)-9-(p-methoxyphenyl) carbazole having the following formula:

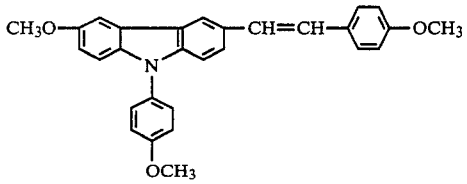

and 10 parts by weight of a polycarbonate, "Panlite L-1250" of Teijin Chemicals Ltd., was dissolved in 90 parts by weight of 1,2-dichloroethene, and the resulting solution was applied to the carrier generating layer to thereby form a carrier transporting layer in a dry thickness of 10 microns.

The photoreceptor thus prepared was subjected to the same test as in Example 1, with the results shown in Table 2.

COMPARATIVE EXAMPLE 2

A comparative sample of ptotoreceptor was prepared by repeating the procedure of Example 1 except that the following bisazo compound was used as the carrier generating material.

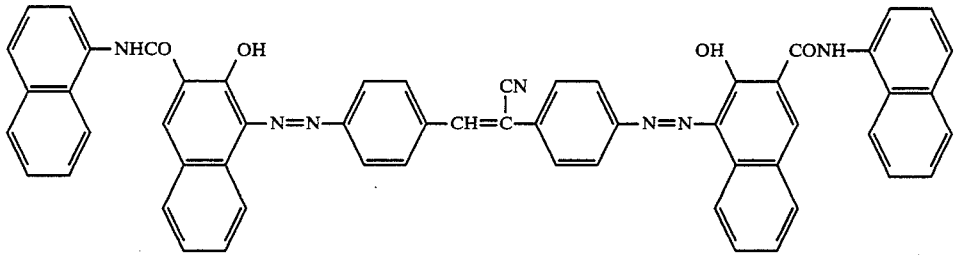

The sample was subjected to the same test as in Example 1, with the results shown in Table 2.

TABLE 2

| | | 15° C. | 25° C. | 35° C. |
|---|---|---|---|---|
| Example 2 | $E_{250}^{500}$ (lux · sec) | 2.6 | 2.4 | 2.3 |
| | $E_{50}^{500}$ (lux · sec) | 5.5 | 5.1 | 4.8 |
| | $V_R$ (V) | 0 | 0 | 0 |
| Comparative Example 2 | $E_{250}^{500}$ (lux · sec) | 3.0 | 2.5 | 2.3 |
| | $E_{50}^{500}$ (lux · sec) | 6.8 | 5.3 | 4.9 |
| | $V_R$ (V) | −10 | 0 | 0 |

The above data shows that the photoreceptor of the present invention had higher sensitivity and lower residual potential than the comparative sample, and its characteristics were little dependent on temperature.

EXAMPLES 3 to 7

Photoreceptor samples of the present invention were prepared as in Example 1 except that bisazo compounds (3), (7), (11), (15) and (18) were used as carrier generating materials. Each sample was subjected to the same test as in Example 1. The data on $E_{250}^{500}$ is shown in Table 3 below.

TABLE 3

| | | $E_{250}^{500}$ (lux · sec) | | |
|---|---|---|---|---|
| Example No. | Bisazo compound | 15° C. | 25° C. | 35° C. |
| 3 | (3) | 2.6 | 2.3 | 2.2 |
| 4 | (7) | 2.9 | 2.7 | 2.6 |
| 5 | (11) | 3.3 | 3.0 | 2.8 |
| 6 | (15) | 2.9 | 2.6 | 2.4 |

TABLE 3-continued

| Example No. | Bisazo compound | $E_{250}^{500}$ (lux · sec) 15° C. | 25° C. | 35° C. |
|---|---|---|---|---|
| 7 | (18) | 3.4 | 3.2 | 3.0 |

EXAMPLE 8

A polyester film laminated with an aluminum foil was coated with an intermediate layer the same as formed in Example 2. A dispersion of 2 parts by weight of bisazo compound (4) and 2 parts by weight of polycarbonate, "Panlite L-1250" of Teijin Chemicals Ltd. in 140 parts by weight of 1,2-dichloroethane was applied onto the intermediate layer to form a carrier generating layer in a dry thickness of 1 micron.

Then, a mixture of 6 parts by weight of 1-phenyl-3-(p-diethylaminostyryl)-5-(p-diethylaminophenyl)pyrazoline having the following formula:

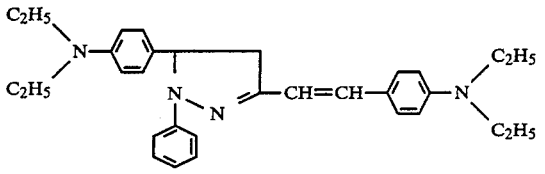

and 10 parts by weight of an acrylic resin, "Acrypet" of Mitsubishi Rayon Company Limited, was dissolved in 70 parts by weight of tetrahydrofuran, and the resulting solution was applied to the carrier generating layer to thereby form a carrier transporting layer in a dry thickness of 12 microns.

The photoreceptor thus produced was subjected to measurements of $E_{250}^{500}$ at 15° C., 25° C. and 35° C. as in Example 1. The results are shown in Table 4.

COMPARATIVE EXAMPLE 3

A comparative sample of photoreceptor was prepared by repeating the procedure of Example 8 except that the following bisazo compound was used as the carrier generating material.

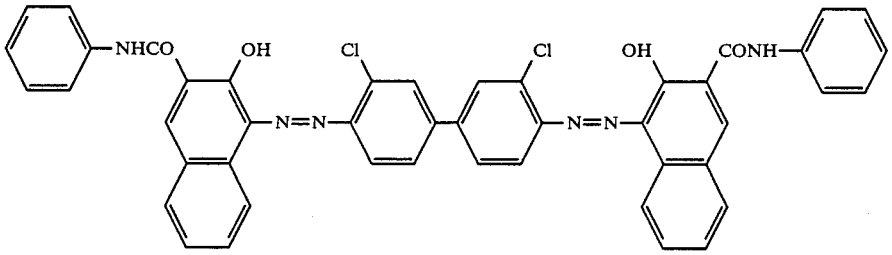

The sample was subjected to the same test as in Example 8, with the results shown in Table 4.

TABLE 4

| | $E_{250}^{500}$ (lux · sec) 15° C. | 25° C. | 35° C. |
|---|---|---|---|
| Example 8 | 6.2 | 5.8 | 5.6 |
| Comparative Example 3 | 6.8 | 5.9 | 5.5 |

The above data shows that the photoreceptor of the present invention had much smaller temperature-dependency than the comparative sample.

EXAMPLE 9

A polyester film having an aluminum deposited layer was coated with the same intermediate layer as formed in Example 1. A dispersion of 2 parts by weight of bisazo compound (5) in 140 parts by weight of 1,2-dichloroethane was applied onto the intermediate layer to form a carrier generating layer in a dry thickness of 0.4 micron.

Then, a mixture of 6 parts by weight of 1,1-bis (4-dibenzylamino-2-methoxyphenyl)butane and 10 parts by weight of polyester, "Vylon 200" of Toyobo Co., Ltd. was dissolved in 90 parts by weight of 1,2-dichloroethane, and the resulting solution was applied to the carrier generating layer to form a carrier transporting layer in a dry thickness of 12 microns.

Figure 8:
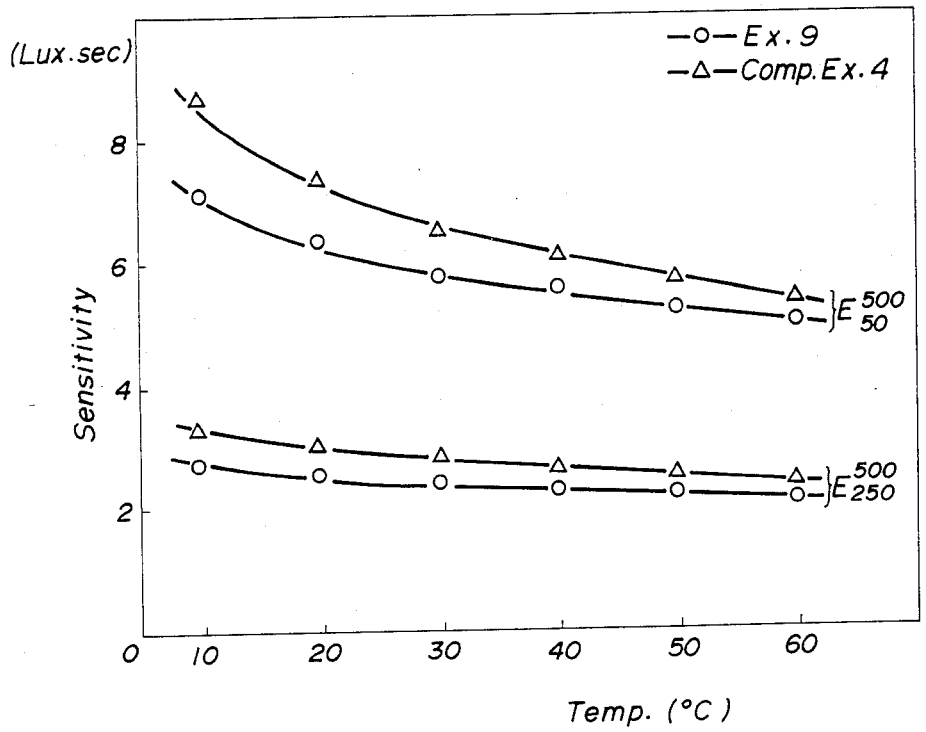
FIG. 8 is a graph showing the temperature versus sensitivity profile of the samples prepared in Example 9 and Comparative Example 4.

The photoreceptor thus prepared was subjected to measurements of $E_{250}^{500}$ and $E_{50}^{500}$ in a constant bath temperature (10° C., 20° C., 30° C., 40° C., 50° C. and 60° C.) with a charging/exposing device of our own making and a vibrating-reed surface potentiometer Model SSV II-30 of Kawaguchi Electric Works Co., Ltd. The results are depicted in FIG. 8.

COMPARATIVE EXAMPLE 4

A comparative sample of photoreceptor was prepared by repeating the procedure of Example 8 except that a bisaco compound of the following formula was used as the carrier generating material:

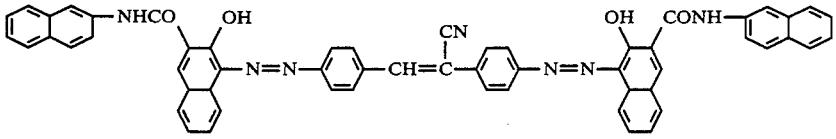

The sample was subjected to the same test as in Example 9, with the results depicted in FIG. 8. The data shows that the sensitivity of the photoreceptor sample of the present invention remained constant over a wider temperature range than the comparative sample.

EXAMPLE 10

A polyester film laminated with an aluminum foil was coated with an intermediate layer of polyester, "Vylon 200" of Toyobo Co., Ltd., in a thickness of 0.5 micron. A dispersion of 2 parts by weight of bisazo compound (8) and 2 parts by weight of polycarbonate, "Jupilon S-1000" of Mitsubishi Gas Chemical Company Inc. in 140 parts by weight of 1,2-dichloroethane was applied to the intermediate layer to form a carrier generating layer in a dry thickness of 1 micron.

Then, a mixture of 6 parts by weight of a hydrazone compound of the following formula:

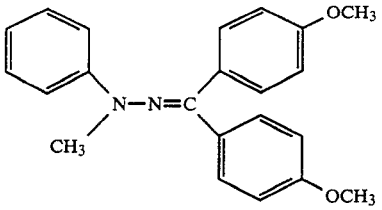

and 10 parts by weight of polycarbonate, "Jupilon S-1000" of Mitsubishi Gas Chemical Company Inc. was dissolved in 90 parts by weight of 1,2-dichloroethane, and the resulting solution was applied onto the carrier generating layer to form a carrier transporting layer in a dry thickness of 15 microns.

The photoreceptor thus prepared was subjected to a copying test in a constant temperature room (15° C.) with an electrophotographic copier U-Bix 2000R of Konishiroku Photo Industry Co., Ltd. A sharp copy with faithful and high-contrast image of good tone was produced. The same result was obtained even after 10,000 cpies were made. This test shows that the photoreceptor of the present invention had good characteristics and long printing life at low temperatures.

COMPARATIVE EXAMPLE 5

A comparative sample of photoreceptor was prepared as in Example 10 except that a bisazo compound of the following formula was used as the carrier generating material:

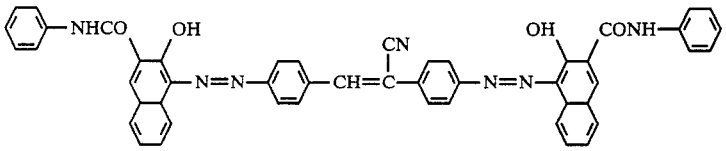

The sample was subjected to copying test as in Example 10, but in an early stage of the copying operation, a blurred image having high fog and low contrast was obtained. This indicates that the sensitivity of the sample decreased appreciably at low temperatures.

What is claimed is:

1. An electrophotographic photoreceptor comprising an electrically conductive support having formed thereon a light-sensitive layer containing a bisazo compound of formula (I):

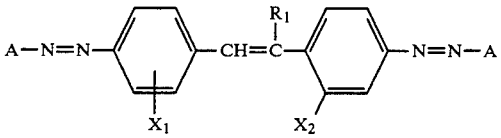

(wherein $R_1$ is a cyano group, a chlorine atom or a bromine atom; $X_1$ is a halogen atom, an alkyl group, an alkoxy group or a cyano group; $X_2$ is a hydrogen atom, a halogen atom, an alkyl atom or an alkoxy group; A is

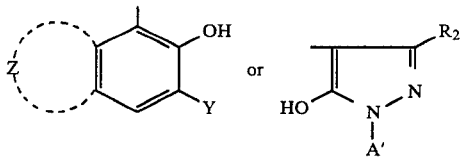

wherein Y is a carbamoyl group or a sulfamoyl group; Z is an atomic group necessary for forming an aromatic hydrocarbon ring or a heteroaromatic ring; $R_2$ is a hydrogen atom, an amino group, a carbamoyl group, a carboxy group or an ester group thereof; and A' is an aryl group).

2. An electrophotographic photoreceptor according to claim 1 wherein $X_1$ is an alkyl, an alkoxy or a halogen atom.

3. An electrophotographic photoreceptor according to claim 1 wherein the alkyl is an alkyl having one to four carbon atoms.

4. An electrophotographic photoreceptor according to claim 1 wherein said photoreceptor further includes at least one layer containing a carrier transporting material.

5. A photoreceptor of claim 1 wherein $X_1$ is an alkyl, alkoxy, or a cyano group.

6. The photoreceptor of claim 1 wherein $X_2$ is a hydrogen, an alkyl, or an alkoxy.

7. An electrophotographic photoreceptor comprising an electrically conductive support and a light-sensitive layer thereon wherein said layer contains a bisazo compound of the Formula I

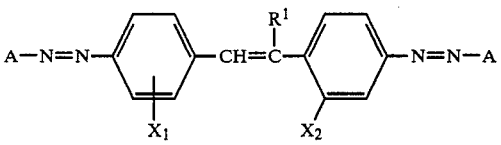

I wherein $R_1$ is cyano, chlorine, or bromine; $X_1$ is an alkyl, an alkoxy, or a cyano; $X_2$ is a hydrogen, an alkyl, or an alkoxy; A is

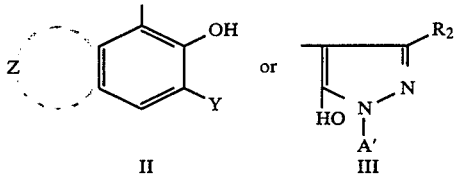
wherein Y is a carbamoyl or a sulfamoyl; Z is a group necessary for the completion of an aromatic hydrocarbon ring or a heteroaromatic ring; $R_2$ is a hydrogen, an amino, a carbamoyl, a carboxy or an ester thereof; and A' is an aryl group.
8. The photoreceptor of claim 1 wherein said bisazo compound is selected from
(1)
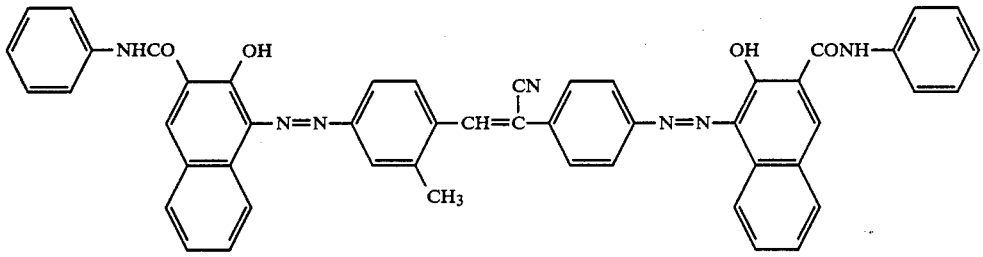
(2)
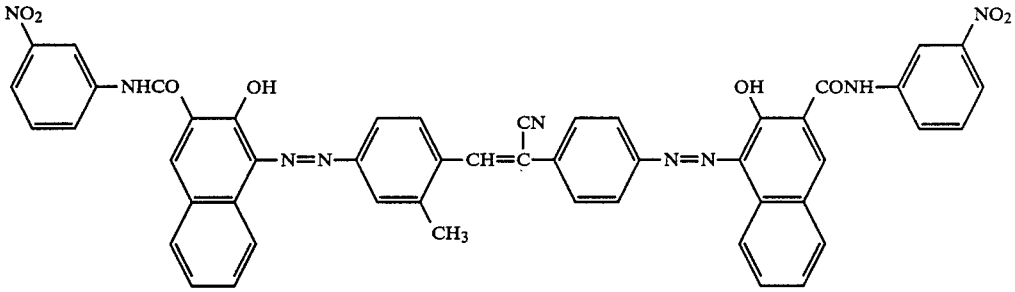
(3)
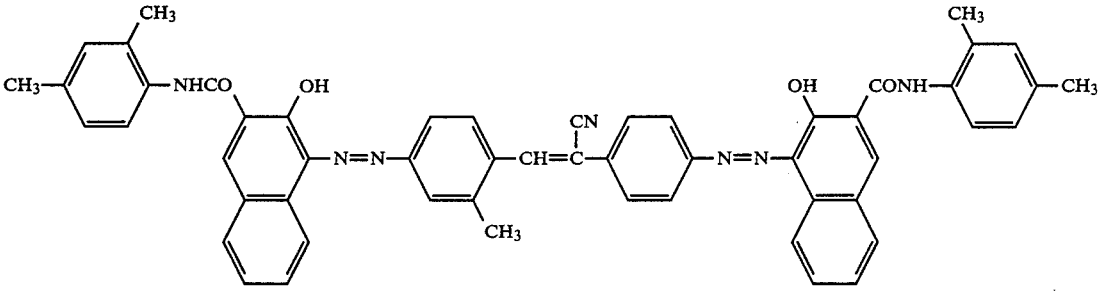
(4)
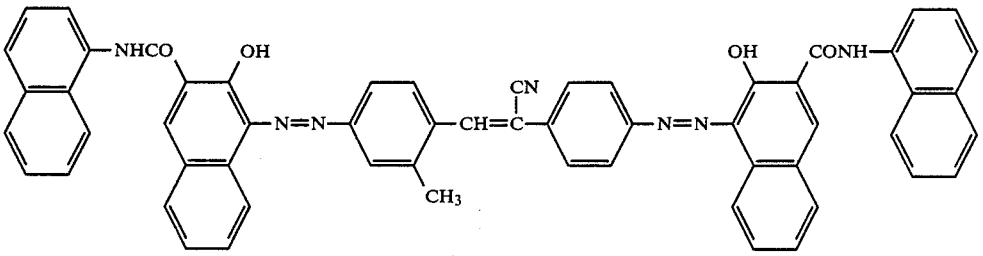
(5)
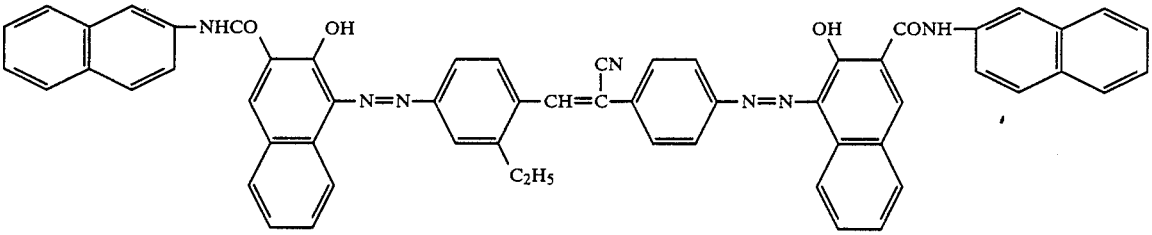

-continued
(6)
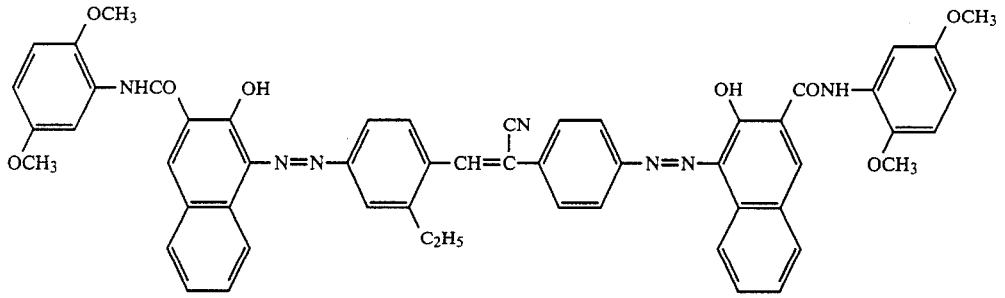
(7)
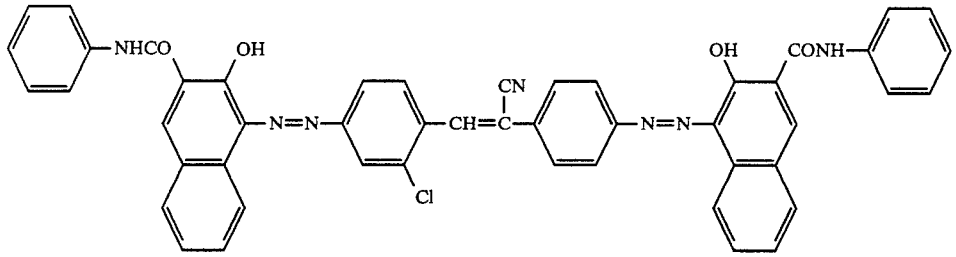
(8)
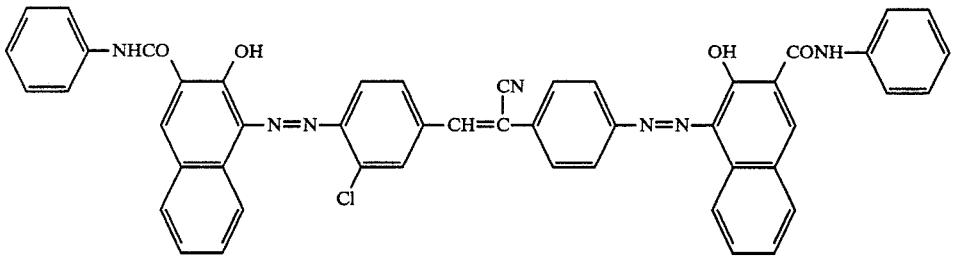
(9)
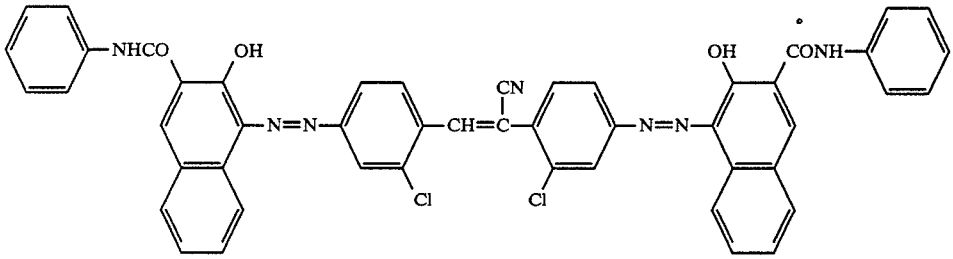
(10)
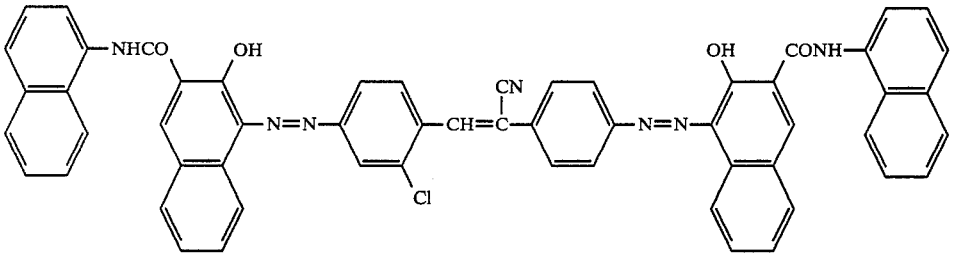
(11)
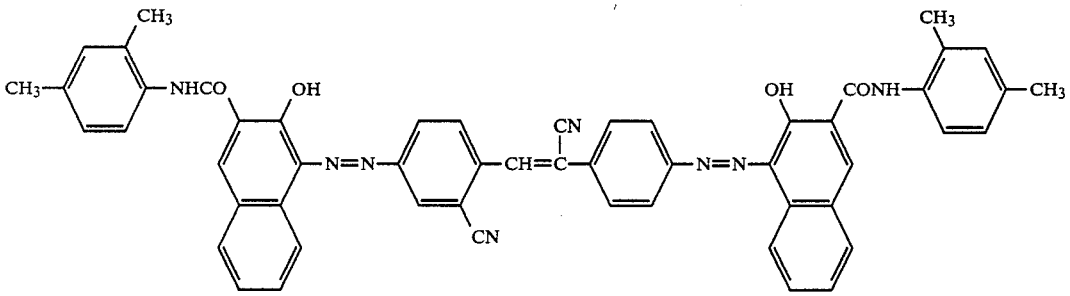

-continued
(12)
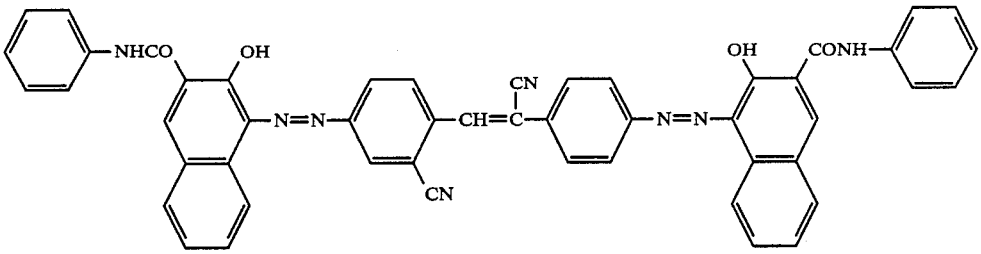
(13)
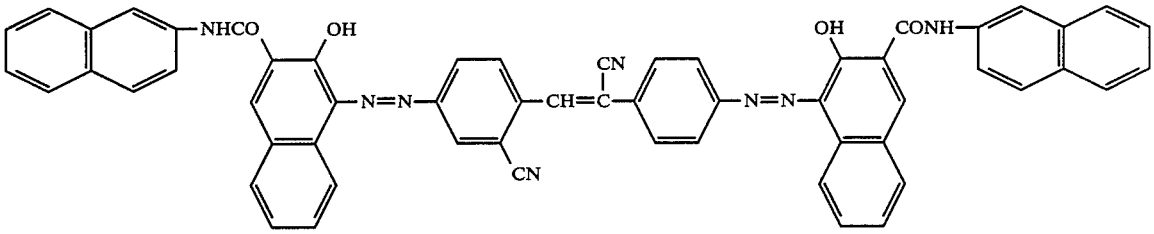
(14)
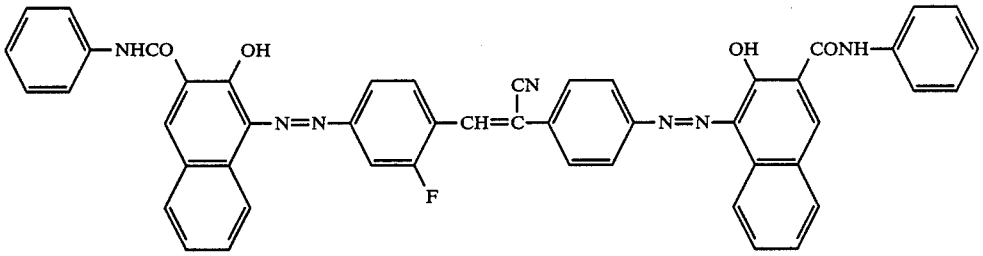
(15)
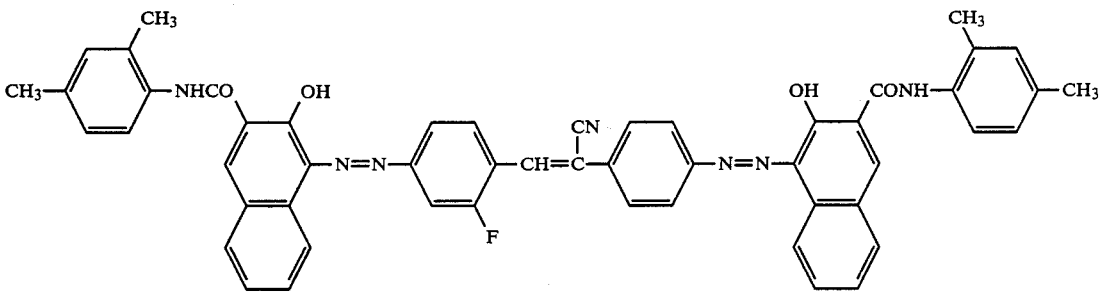
(16)
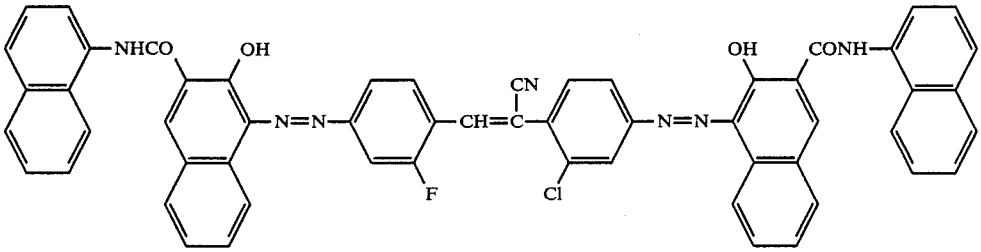
(17)
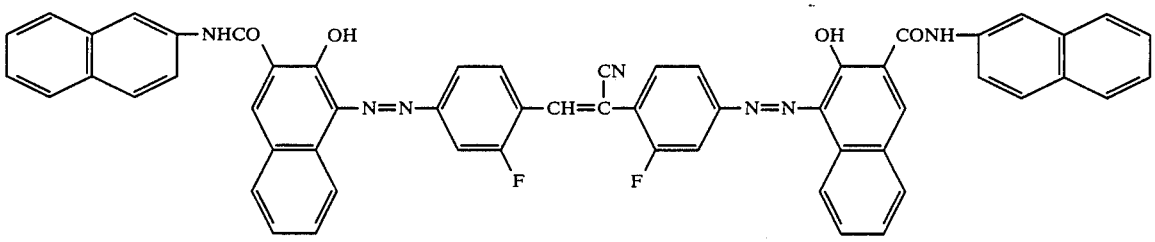

-continued
(18)
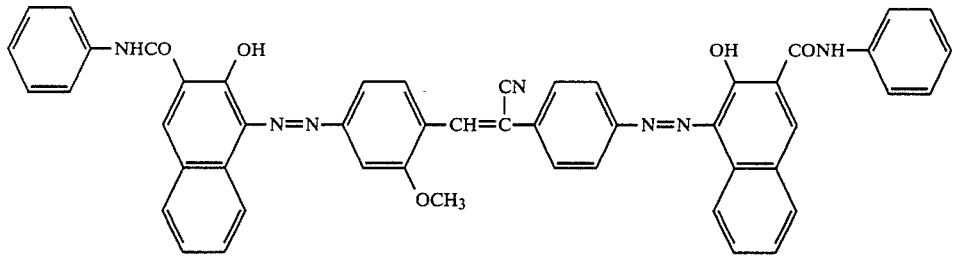
(19)
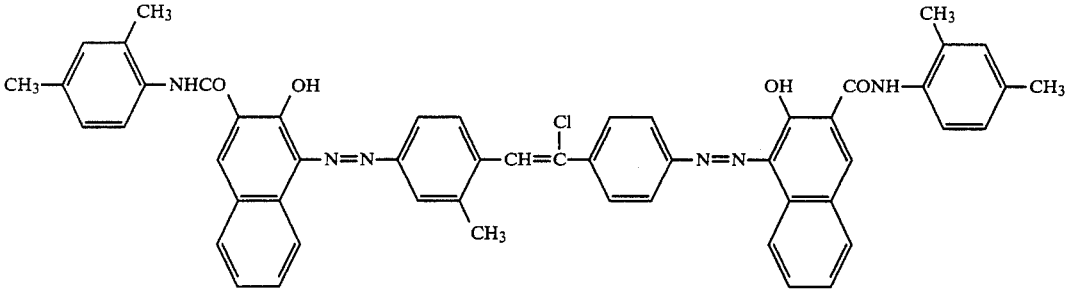
(20)
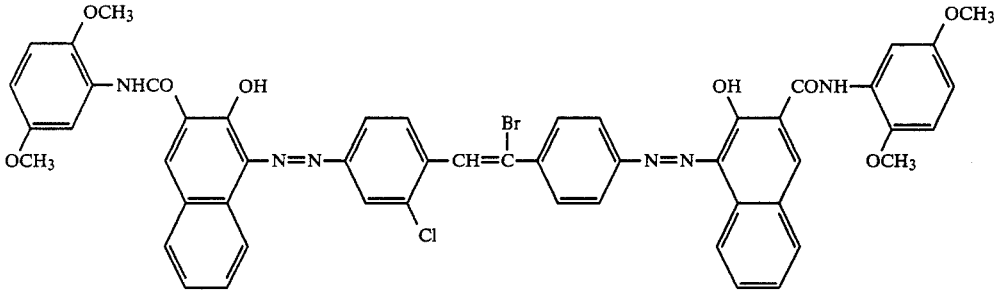
(21)
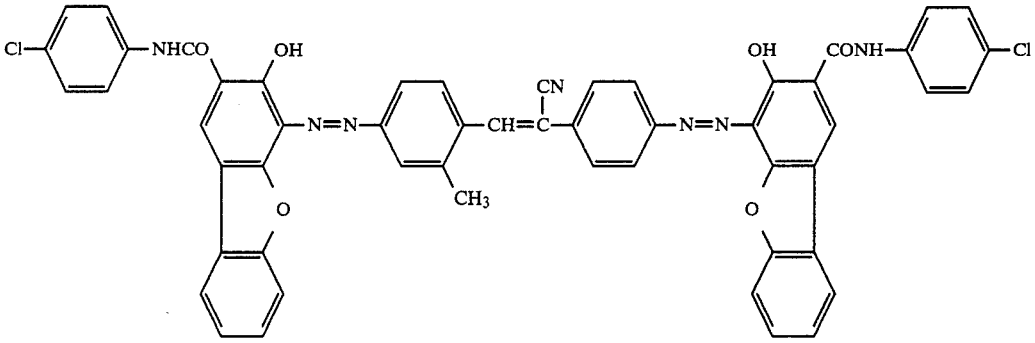
(22)
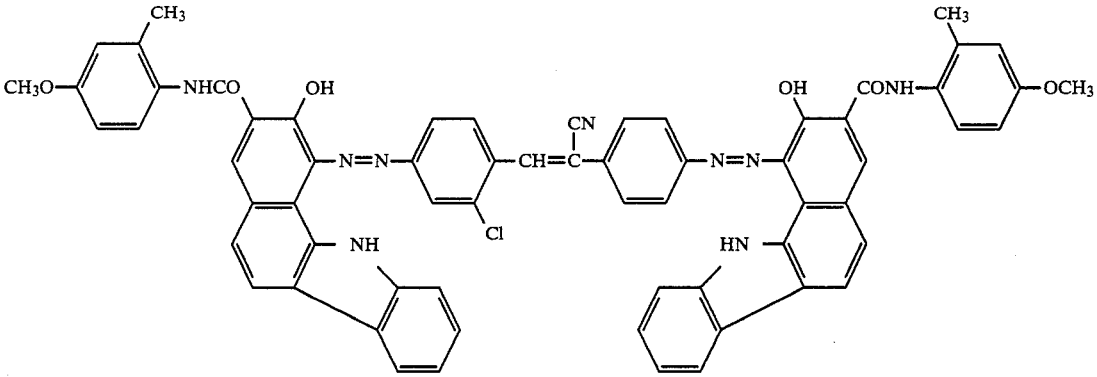

-continued
(23)
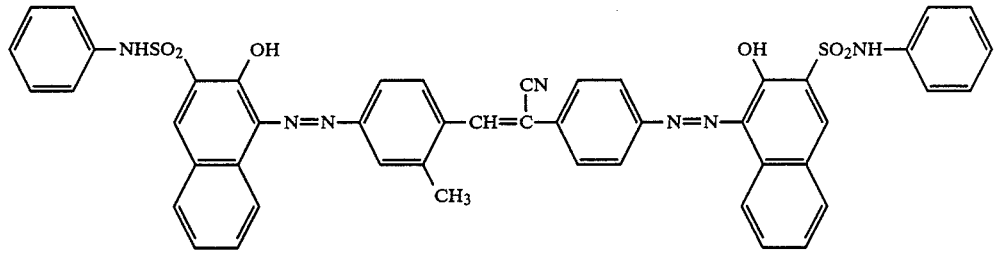
(24)
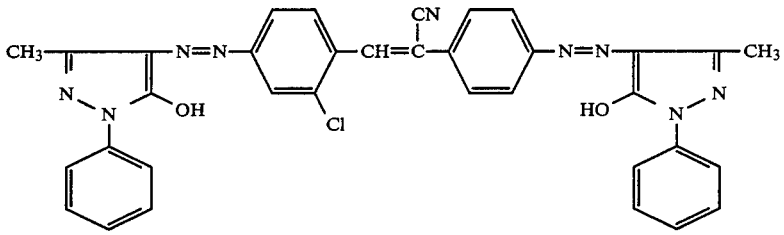
(25)
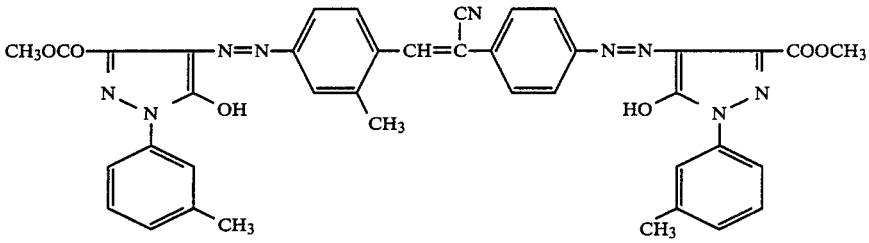
(26)
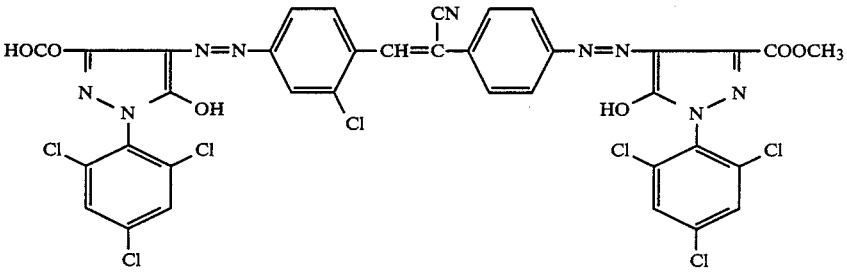
(27)
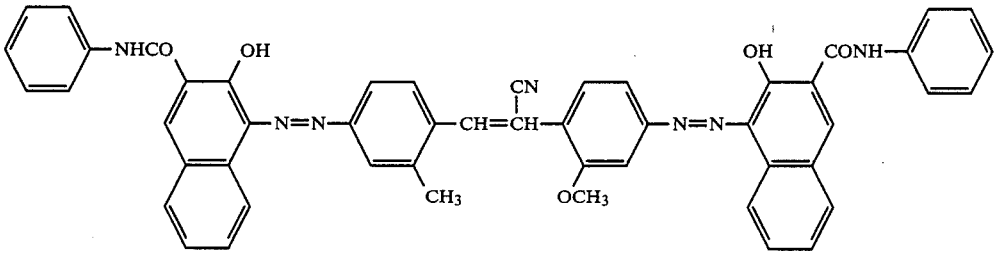
9. The photoreceptor of claim 8 wherein said bisazo compound is selected from (1)
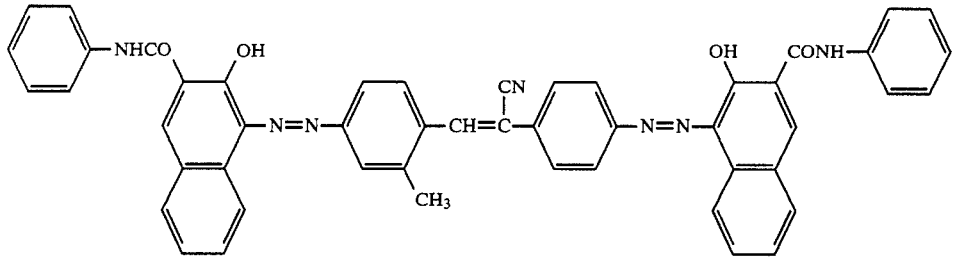
(2)
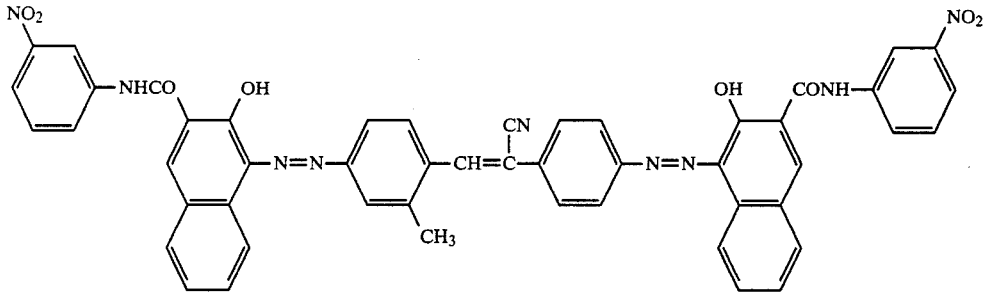
(3)
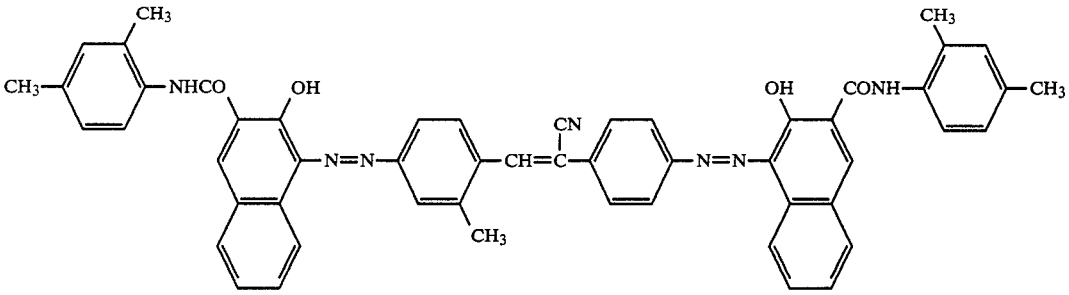
(4)
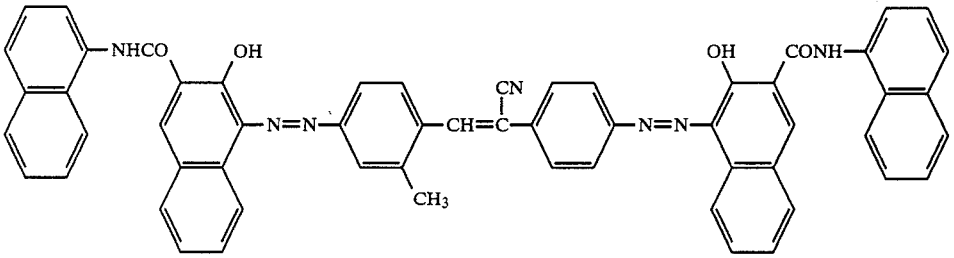
(5)
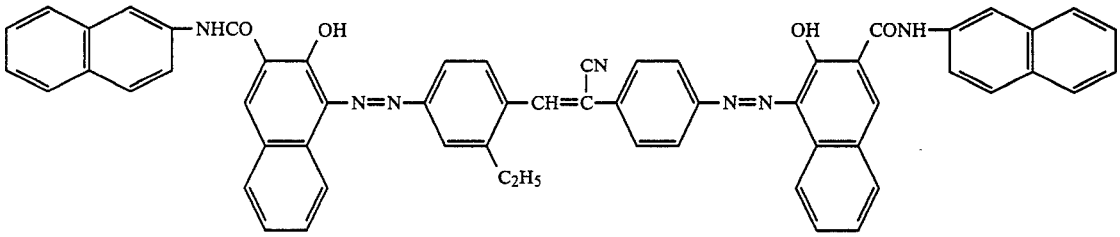

-continued
(6)
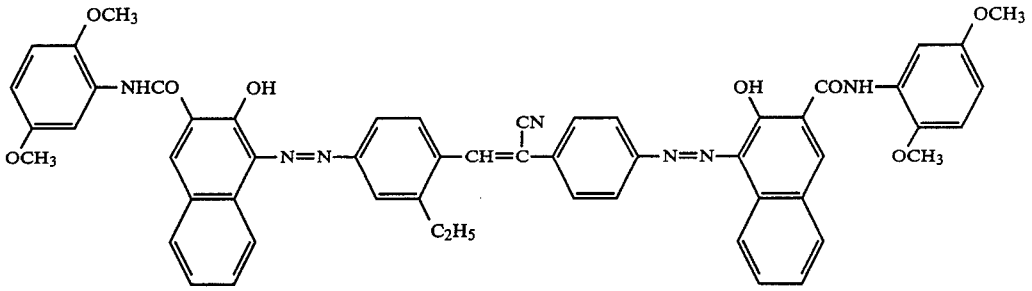
(11)
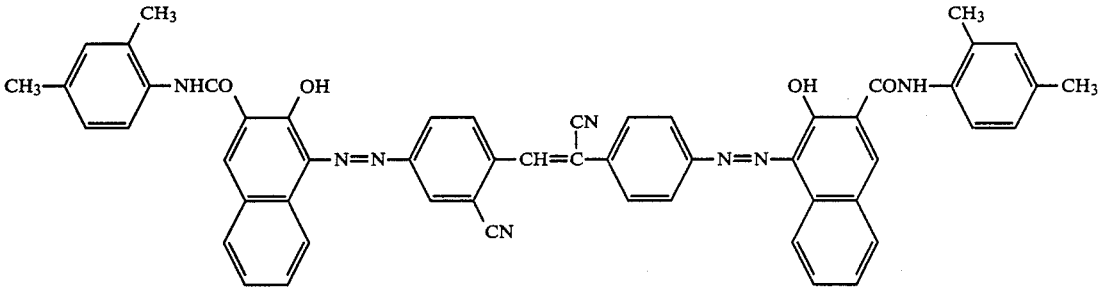
(12)
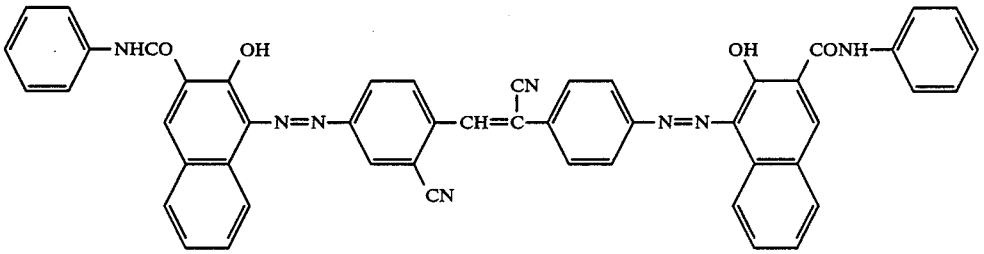
(13)
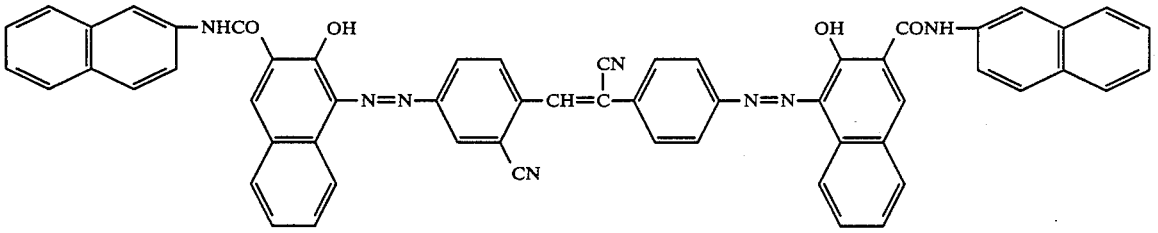
(18)
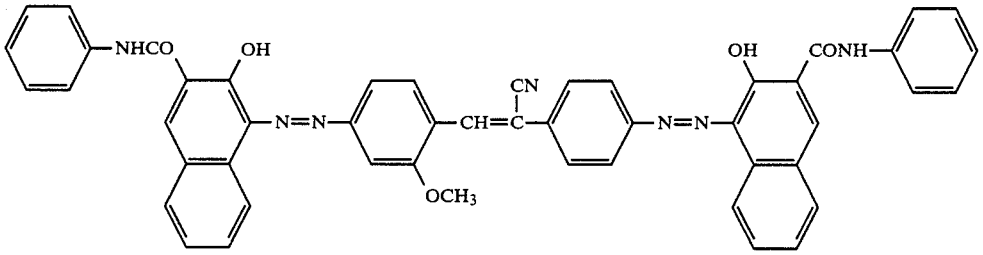

-continued
(19)
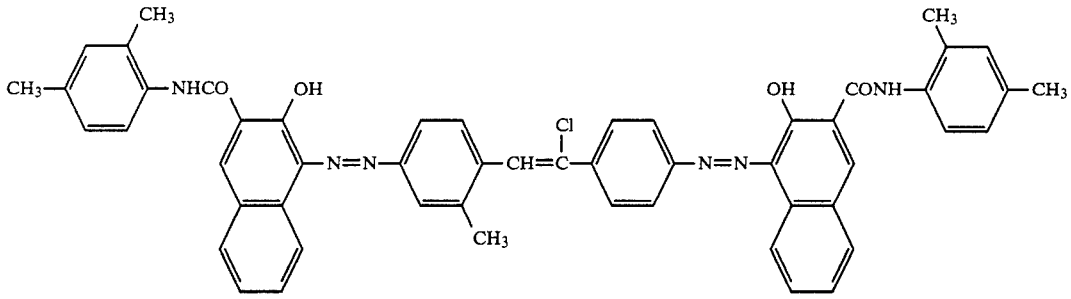
(23)
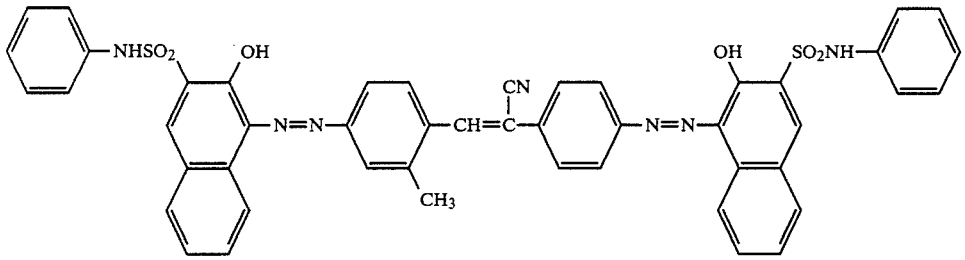
(25)
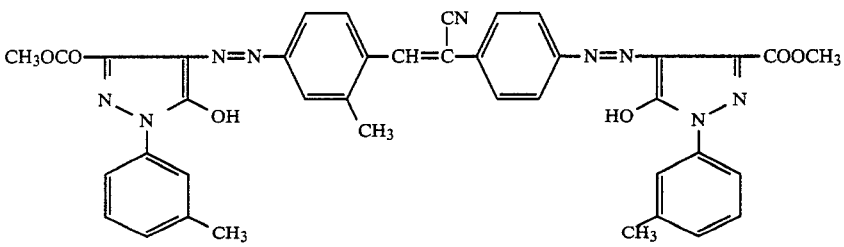
(27)
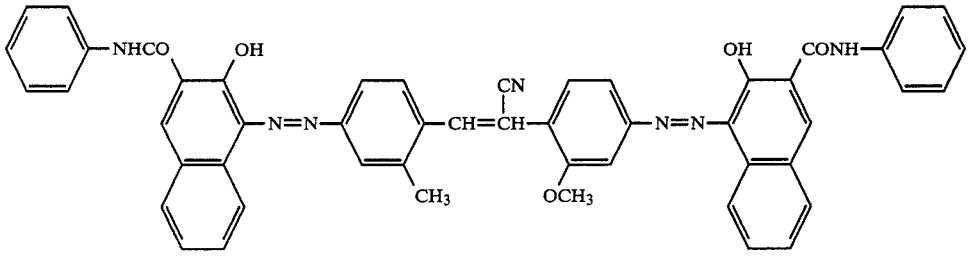
10. The photoreceptor of claim 8 wherein said bisazo compound is selected from
(1)
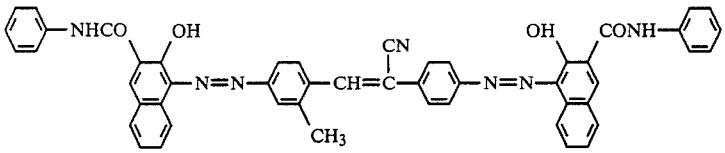
(2)
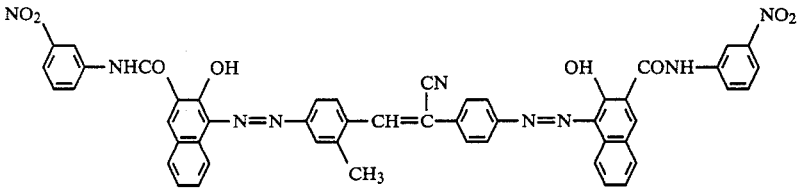

-continued
(3)
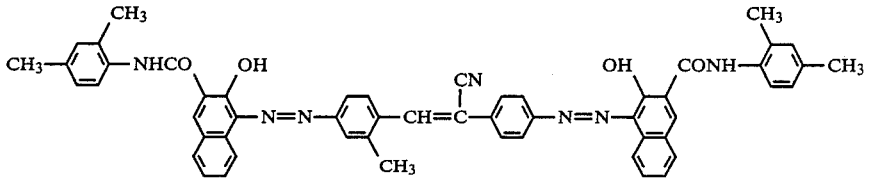
(4)
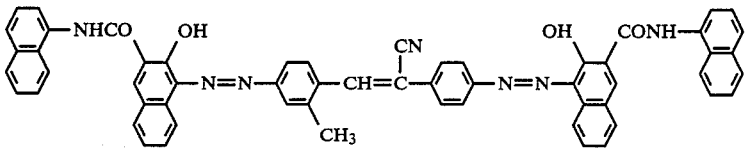
(5)
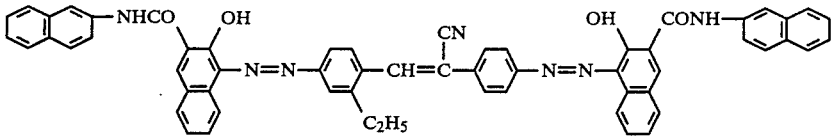
(6)
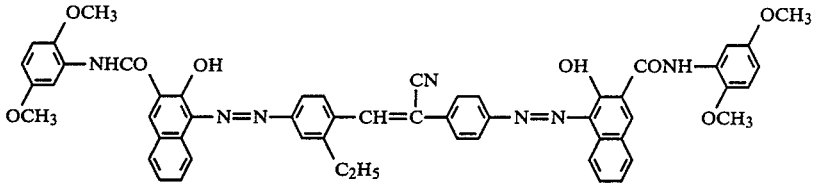
(7)
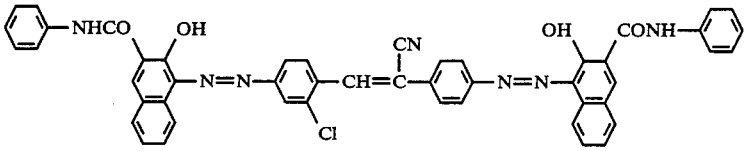
(8)
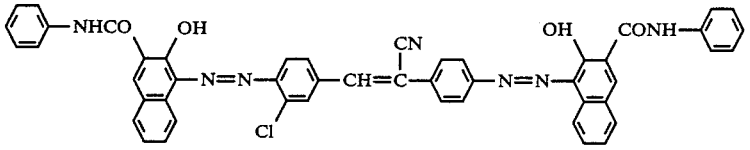
(10)
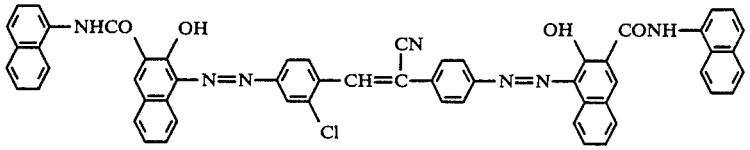
(11)
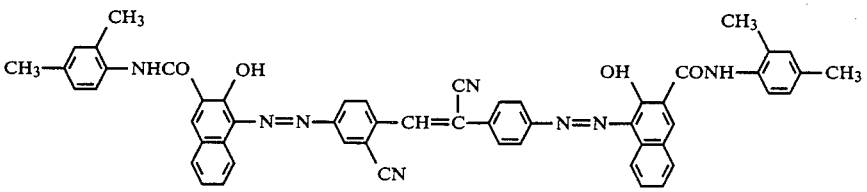
(12)
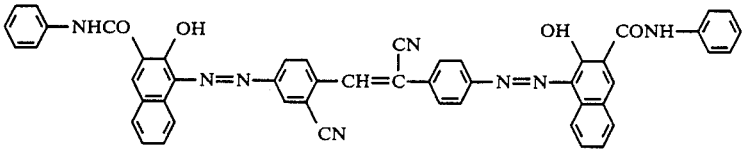

-continued
(13)
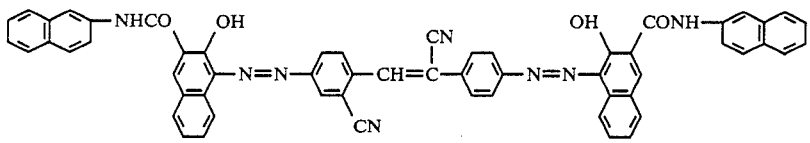
(14)
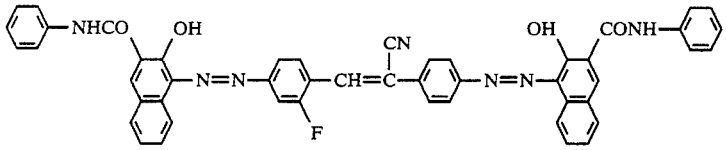
(15)
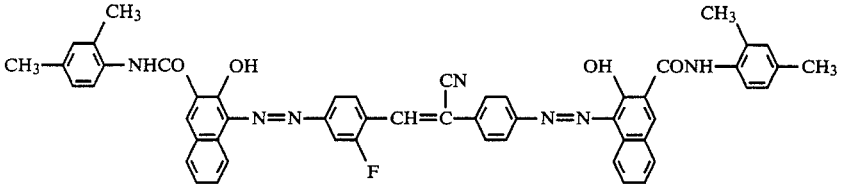
(18)
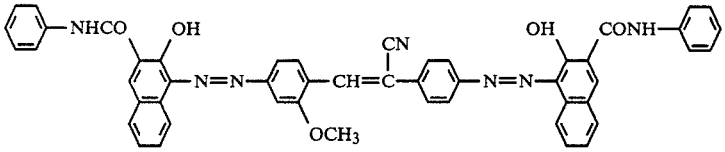
(19)
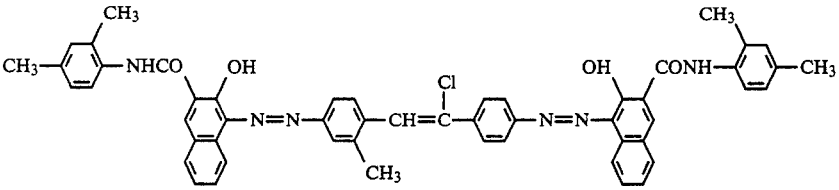
(20)
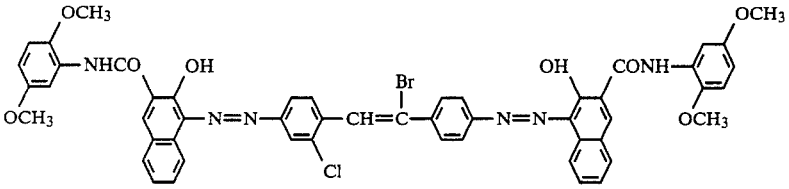
(21)
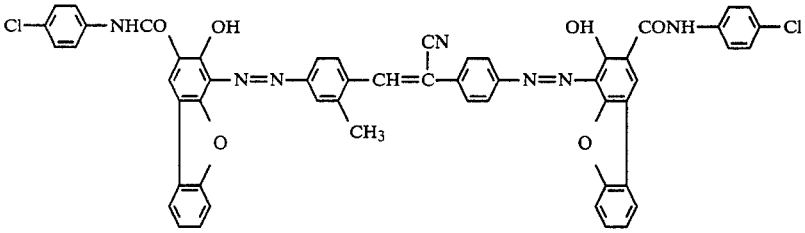
(22)
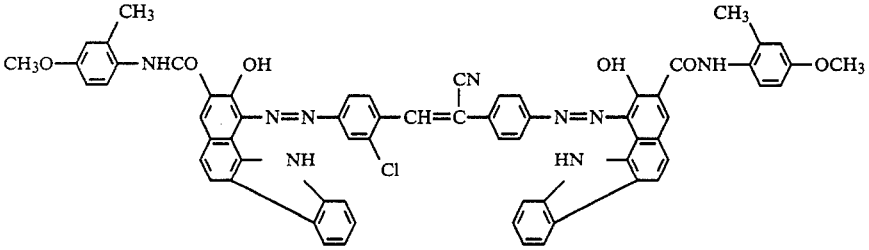

-continued
(23)
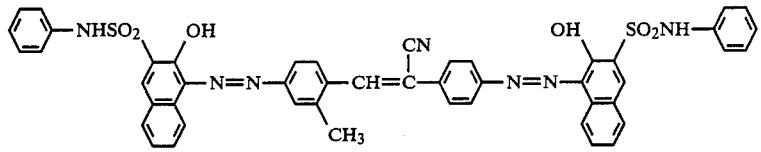
(24)
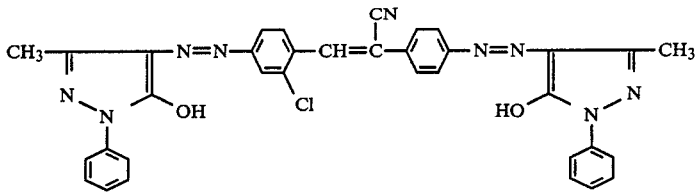
(25)
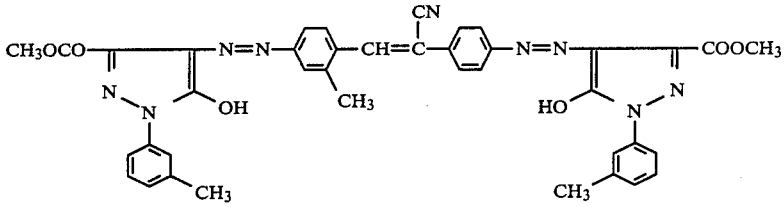
(26)
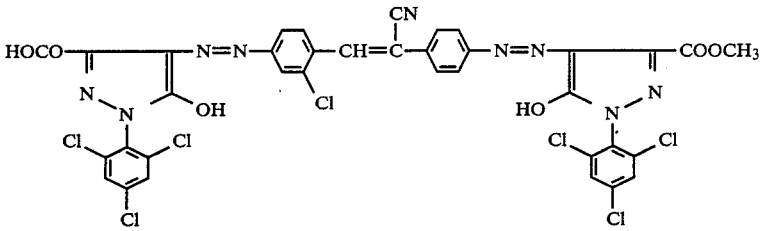
(27)
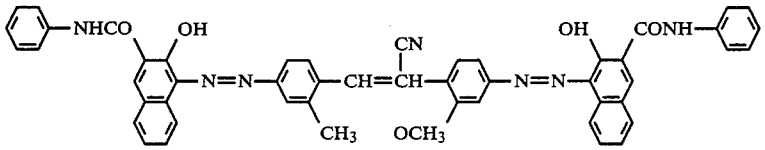
11. An electrophotographic photoreceptor comprising an electrically conductive support having a light-sensitive layer formed thereon, said layer comprising a bisazo compound selected from
(1)
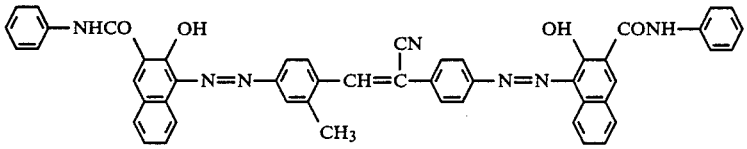
(2)
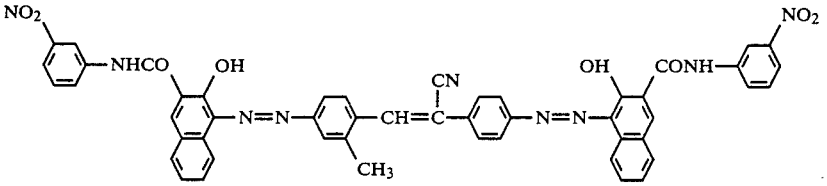

-continued
(3)
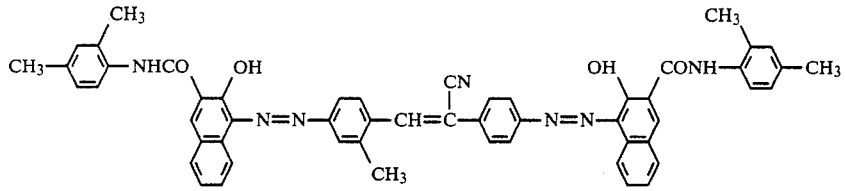
(4)
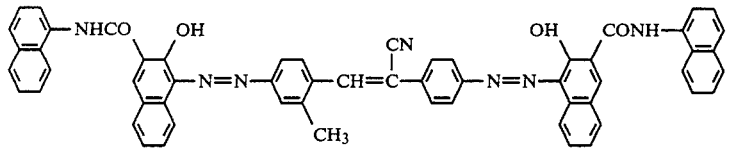
(5)
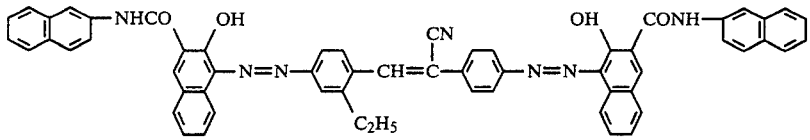
(6)
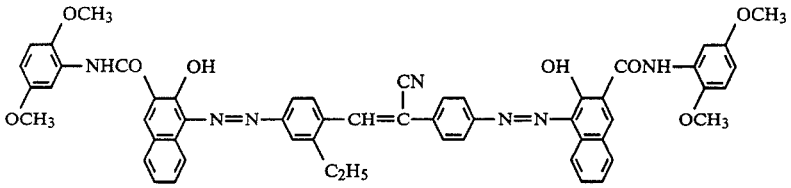
(11)
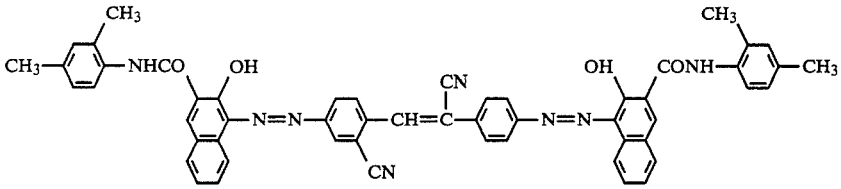
(12)
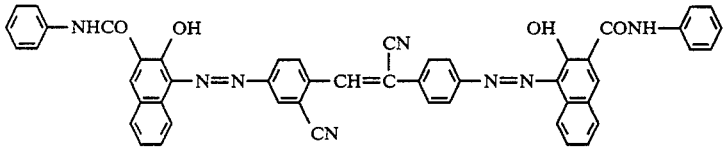
(13)
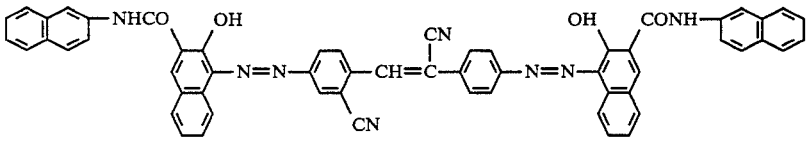
(18)
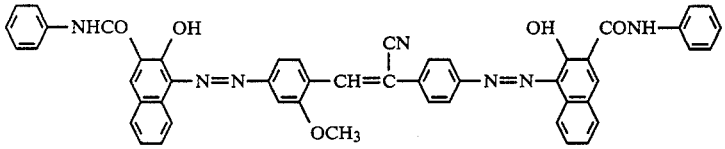
(19)
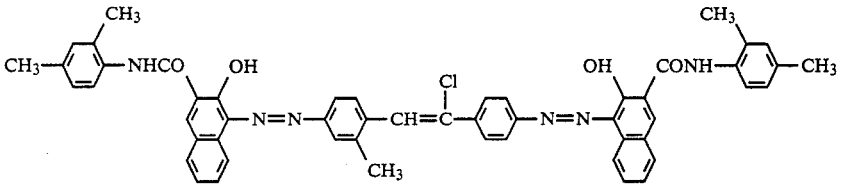

-continued
(22)
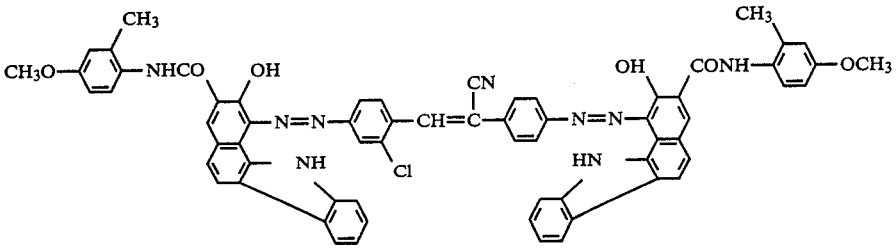
(23)
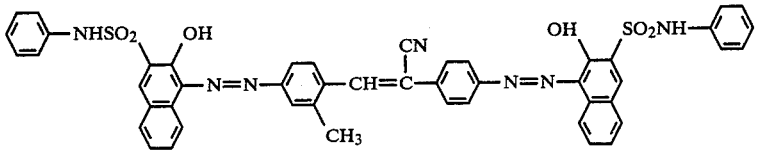
(25)
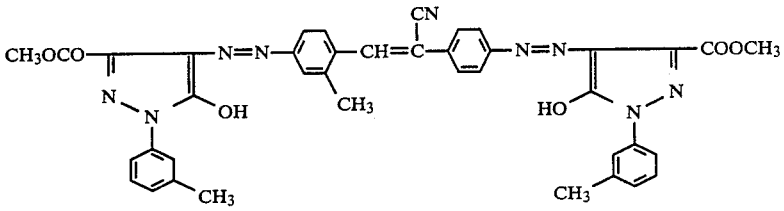
(27)
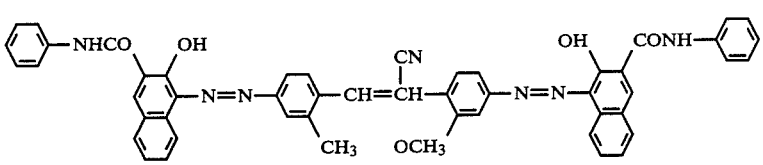
* * * * *